US010533546B2

(12) United States Patent
Kim et al.

(10) Patent No.: US 10,533,546 B2
(45) Date of Patent: Jan. 14, 2020

(54) LINEAR COMPRESSOR

(71) Applicant: LG ELECTRONICS INC., Seoul (KR)

(72) Inventors: Hyunsoo Kim, Seoul (KR); Donghan Kang, Seoul (KR); Junghae Kim, Seoul (KR); Kwangwoon Ahn, Seoul (KR); Eonpyo Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 330 days.

(21) Appl. No.: 15/585,331

(22) Filed: May 3, 2017

(65) Prior Publication Data

US 2017/0321683 A1 Nov. 9, 2017

(30) Foreign Application Priority Data

May 3, 2016 (KR) ..... 10-2016-0054906

(51) Int. Cl.

| | |
|---|---|
| ***F04B 39/12*** | (2006.01) |
| ***F04B 39/00*** | (2006.01) |
| ***F04B 39/10*** | (2006.01) |
| ***F04B 39/02*** | (2006.01) |
| *F04B 35/04* | (2006.01) |

(52) U.S. Cl.

CPC ..... *F04B 39/127* (2013.01); *F04B 39/0292* (2013.01); *F04B 39/121* (2013.01); *F04B 39/123* (2013.01); *F04B 35/04* (2013.01); *F04B 39/0061* (2013.01); *F04B 39/10* (2013.01)

(58) Field of Classification Search

CPC .. F04B 39/127; F04B 39/0292; F04B 35/045; F04B 35/04; F04B 39/123; F04B 39/0061; F04B 39/121; F04B 39/10

See application file for complete search history.

(56) References Cited

U.S. PATENT DOCUMENTS

| | | | | |
|---|---|---|---|---|
| 8,109,740 | B2 * | 2/2012 | Kang | F04B 39/121 417/417 |
| 10,280,914 | B2 * | 5/2019 | Han | F04B 35/04 |
| 10,323,630 | B2 * | 6/2019 | Kang | F04B 39/121 |
| 2006/0210411 | A1 | 9/2006 | Hyeon | |
| 2007/0009370 | A1 | 1/2007 | Kim et al. | |

(Continued)

FOREIGN PATENT DOCUMENTS

| | | |
|---|---|---|
| AU | 2004243788 | 12/2004 |
| AU | 2013 237 743 | 1/2016 |

(Continued)

OTHER PUBLICATIONS

European Search Report dated Feb. 5, 2018.

(Continued)

*Primary Examiner* — Nathan C Zollinger
(74) *Attorney, Agent, or Firm* — Ked & Associates LLP

(57) ABSTRACT

A linear compressor is provided. The linear compressor may include a cylinder including a cylinder body that defines a compression space for a refrigerant and a cylinder flange that extends from the cylinder body in a radial direction; a piston that reciprocates within the cylinder in an axial direction; and a frame coupled to the cylinder. The frame may include a frame body into which the cylinder body may be inserted and a first press-fitting portion press-fitted into the cylinder flange.

15 Claims, 14 Drawing Sheets

(56) References Cited

U.S. PATENT DOCUMENTS

| | | | | |
|---|---|---|---|---|
| 2013/0004343 | A1* | 1/2013 | Cho | F04B 35/045 417/321 |
| 2013/0195613 | A1 | 8/2013 | Kim et al. | |
| 2015/0004027 | A1* | 1/2015 | Kang | F04B 35/045 417/417 |
| 2015/0369224 | A1 | 12/2015 | Kim et al. | |
| 2015/0369238 | A1* | 12/2015 | Park | F04B 35/045 417/437 |

FOREIGN PATENT DOCUMENTS

| | | |
|---|---|---|
| CN | 1771393 | 5/2006 |
| CN | 102792024 | 11/2012 |
| CN | 105298801 | 2/2016 |
| CN | 107304759 | 10/2017 |
| CN | 107339207 | 11/2017 |
| KR | 10-1307688 | 9/2013 |
| KR | 10-2016-0000324 | 1/2016 |
| WO | WO 2004/081378 | 9/2004 |

OTHER PUBLICATIONS

European Search Report dated Oct. 17, 2017 issued in Application No. 17168990.4.
Chinese Office Action dated Aug. 3, 2018 with English Translation.

* cited by examiner

LINEAR COMPRESSOR

CROSS-REFERENCE TO RELATED APPLICATION(S)

The present application claims priority under 35 U.S.C. 119 and 35 U.S.C. 365 to Korean Patent Application No. 10-2016-0054906, filed in Korea on May 3, 2016, which is hereby incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. For this, the cooling system includes a compressor, a condenser, an expansion device, and an evaporator. Also, the cooling system may be installed in a refrigerator or air conditioner which is a home appliance.

In general, compressors are machines that receive power from a power generation device, such as an electric motor or a turbine, to compress air, a refrigerant, or various working gases, thereby increasing pressure. Compressors are being widely used in home appliances or industrial fields.

Compressors may be largely classified into reciprocating compressors, in which a compression space into/from which a working gas is suctioned and discharged, is defined between a piston and a cylinder to allow the piston to be linearly reciprocated into the cylinder, thereby compressing a refrigerant, rotary compressors, in which a compression space into/from which a working gas is suctioned or discharged, is defined between a roller that eccentrically rotates and a cylinder to allow the roller to eccentrically rotate along an inner wall of the cylinder, thereby compressing a refrigerant, and scroll compressors, in which a compression space into/from which a refrigerant is suctioned or discharged, is defined between an orbiting scroll and a fixed scroll to compress a refrigerant while the orbiting scroll rotates along the fixed scroll. In recent years, a linear compressor, which is directly connected to a drive motor, in which a piston linearly reciprocates, to improve compression efficiency without mechanical losses due to movement conversion, and having a simple structure, is being widely developed. In general, the linear compressor may suction and compress a refrigerant while a piston linearly reciprocates in a sealed shell by a linear motor and then discharge the refrigerant.

The linear motor is configured to allow a permanent magnet to be disposed between an inner stator and an outer stator. The permanent magnet may linearly reciprocate by an electromagnetic force between the permanent magnet and the inner (or outer) stator. Also, as the permanent magnet operates in the state in which the permanent magnet is connected to the piston, the permanent magnet may suction and compress the refrigerant while linearly reciprocating within the cylinder and then discharge the refrigerant.

The present applicant has filed a patent (hereinafter, referred to as "Prior Art Document 1") and then has registered the patent with respect to the linear compressor, Korean Patent Registration No. 10-1307688, registered on Sep. 5, 2013 and entitled "LINEAR COMPRESSOR", which is hereby incorporated by reference. The linear compressor according to the Prior Art Document 1 includes a shell for accommodating a plurality of parts. A vertical height of the shell may be somewhat high as illustrated in FIG. 2 of the Prior Art Document 1. Also, an oil supply assembly for supplying oil between a cylinder and a piston may be disposed within the shell.

When the linear compressor is provided in a refrigerator, the linear compressor may be disposed in a machine room provided at a rear side of the refrigerator. In recent years, a major concern of a customer is increasing an inner storage space of the refrigerator. To increase the inner storage space of the refrigerator, it may be necessary to reduce a volume of the machine room. Also, to reduce the volume of the machine room, it may be important to reduce a size of the linear compressor.

However, as the linear compressor disclosed in the Prior Art Document 1 has a relatively large volume, it is necessary to increase a volume of a machine room into which the linear compressor is accommodated. Thus, the linear compressor having a structure disclosed in the Prior Art Document 1 is not adequate for the refrigerator for increasing the inner storage space thereof.

To reduce the size of the linear compressor, it may be necessary to reduce a size of a main part or component of the compressor. In this case, performance of the compressor may deteriorate. To compensate for the deteriorated performance of the compressor, the compressor drive frequency may be increased. However, the more the drive frequency of the compressor is increased, the more a friction force due to oil circulating into the compressor increases, deteriorating performance of the compressor.

To solve these limitations, the present applicant has filed a patent application (hereinafter, referred to as "Prior Art Document 2"), Korean Patent Publication No. 10-2016-0000324 published on Jan. 4, 2016, and entitled "LINEAR COMPRESSOR", which is hereby incorporated by reference. In the linear compressor of the Prior Art Document 2, a gas bearing technology in which a refrigerant gas is supplied in a space between a cylinder and a piston to perform a bearing function is disclosed. The refrigerant gas flows to an outer circumferential surface of the piston through a nozzle of the cylinder to act as a bearing in the reciprocating piston.

On the other hand, the cylinder and the frame according to the Prior Art Document 2 are coupled to each other by a coupling member. When the cylinder and the frame are coupled to each other by the coupling member, a fine gap may exist in a portion where the cylinder and the frame are coupled to each other. A high-pressure refrigerant used as a gas bearing may not move to the nozzle of the cylinder nozzle and may leak out through the gap.

When the refrigerant leaks out, a performance of the gas bearing may deteriorate, thus causing abrasion in the piston or the cylinder. Also, a pressure loss of the compressed refrigerant may be generated, deteriorating a compression efficiency of the compressor.

According to the repeated driving of the compressor, the coupling member may be loosened or may be separated from the cylinder or the frame. In this case, a reliability of the operation of the compressor may be deteriorated. Also, a process of assembling the frame and the cylinder through the coupling member may be complicated and the assembling cost may increase.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, that alternate embodiments included in other retrogressive inventions or falling within the spirit and scope will fully convey the concept to those skilled in the art.

Figure 1:
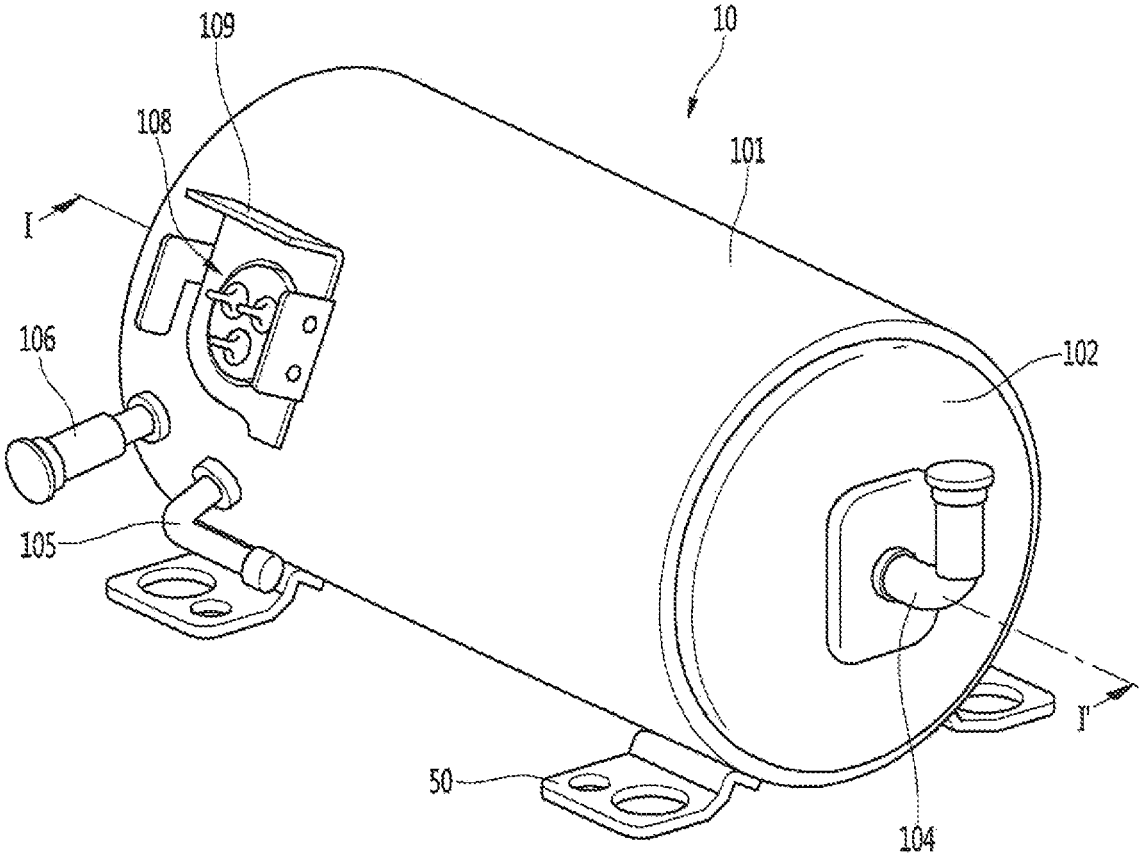
FIG. 1 is a perspective view illustrating an outer appearance of a linear compressor according to an embodiment.
Figure 2:
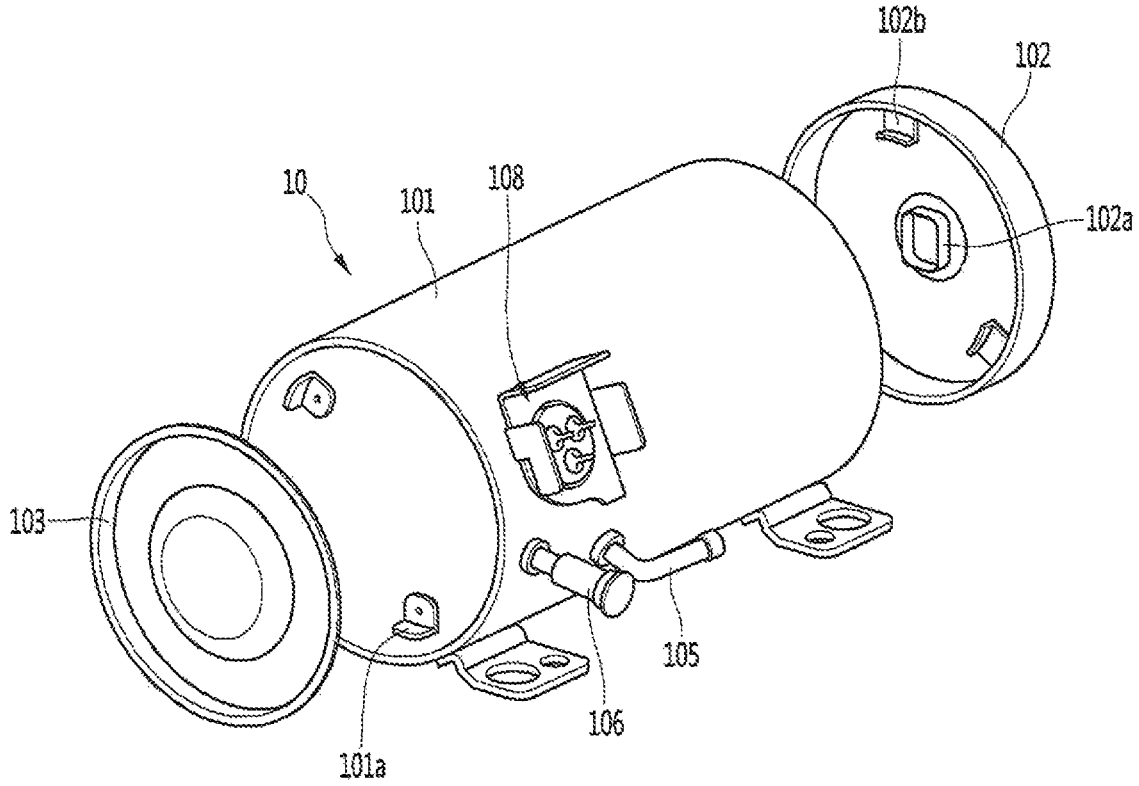
FIG. 2 is an exploded perspective view of a shell and a shell cover of the linear compressor according to an embodiment.

FIG. 1 is a perspective view illustrating an outer appearance of a linear compressor according to an embodiment. FIG. 2 is an exploded perspective view of a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may be understood as a component for transmitting external power to a motor assembly (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 further may include a plurality of pipes 104, 105, and 106 provided in the shell 101 or the shell covers 102 and 103 to suction, discharge, or inject the refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may be compressed while flowing in the axial direction. Also, the compressed refrigerant may be discharged through the discharge pipe 105. The discharge pipe 105 may be disposed at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

At least a portion of the second shell cover 103 may be disposed or provided adjacent to the inner circumferential surface of the shell 101, which corresponds to a point to which the process pipe 106 is coupled. In other words, at least a portion of the second shell cover 103 may act as flow resistance for the refrigerant injected through the process pipe 106.

Thus, in view of the passage of the refrigerant, a passage of the refrigerant introduced through the process pipe 106 may have a size that gradually decreases toward the inner space of the shell 101. In this process, a pressure of the refrigerant may be reduced to allow the refrigerant to be vaporized. Also, in this process, oil contained in the refrigerant may be separated. Thus, the refrigerant from which the oil is separated may be introduced into the piston 130 to improve compression performance of the refrigerant. The oil may be understood as working oil existing in a cooling system.

A cover support part or support 102*a* may be disposed or provided on an inner surface of the first shell cover 102. A second support device 185, which will be described hereinafter, may be coupled to the cover support part 102*a*. The cover support part 102*a* and the second support device 185 may be understood as devices that support a main body of the linear compressor 10. The main body of the compressor represents a part or provided in the shell 101. For example, the main body may include a drive part or drive that reciprocates forward and backward and a support part or support that supports the drive part. The drive part may include parts, such as the piston 130, a magnet frame 138, a permanent magnet 146, a support 137, and a suction muffler 150. Also, the support part may include parts, such as resonant springs 176*a* and 176*b*, a rear cover 170, a stator cover 149, a first support device 165, and a second support device 185.

A stopper 102*b* may be disposed or provided on the inner surface of the first shell cover 102. The stopper 102*b* may be understood as a component that prevents the main body of the compressor, particularly, the motor assembly 140 from being bumped by the shell 101 and thus damaged due to vibration or an Impact occurring during transportation of the linear compressor 10. The stopper 102*b* may be disposed or provided adjacent to the rear cover 170, which will be described hereinafter. Thus, when the linear compressor 10 is shaken, the rear cover 170 may interfere with the stopper 102*b* to prevent the impact from being transmitted to the motor assembly 140.

A spring coupling part 101*a* may be disposed or provided on the inner surface of the shell 101. For example, the spring coupling part 101*a* may be disposed or provided at a position which is adjacent to the second shell cover 103. The spring coupling part 101*a* may be coupled to a first support spring 166 of the first support device 165, which will be described hereinafter. As the spring coupling part 101*a* and the first support device 165 are coupled to each other, the main body of the compressor may be stably supported inside the shell 101.

Figure 3:
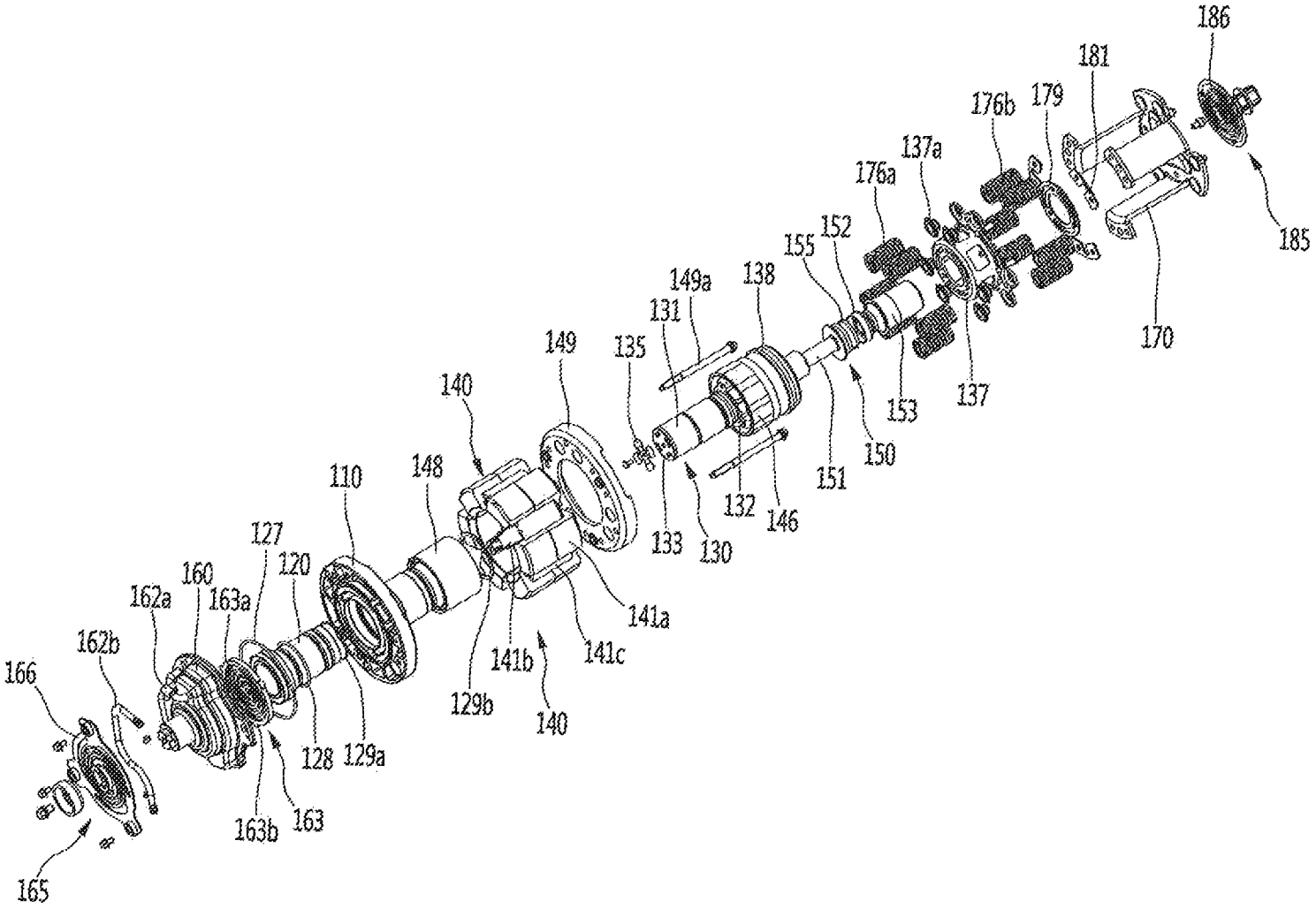
FIG. 3 is an exploded perspective view illustrating internal parts or components of the linear compressor according to an embodiment.
Figure 4:
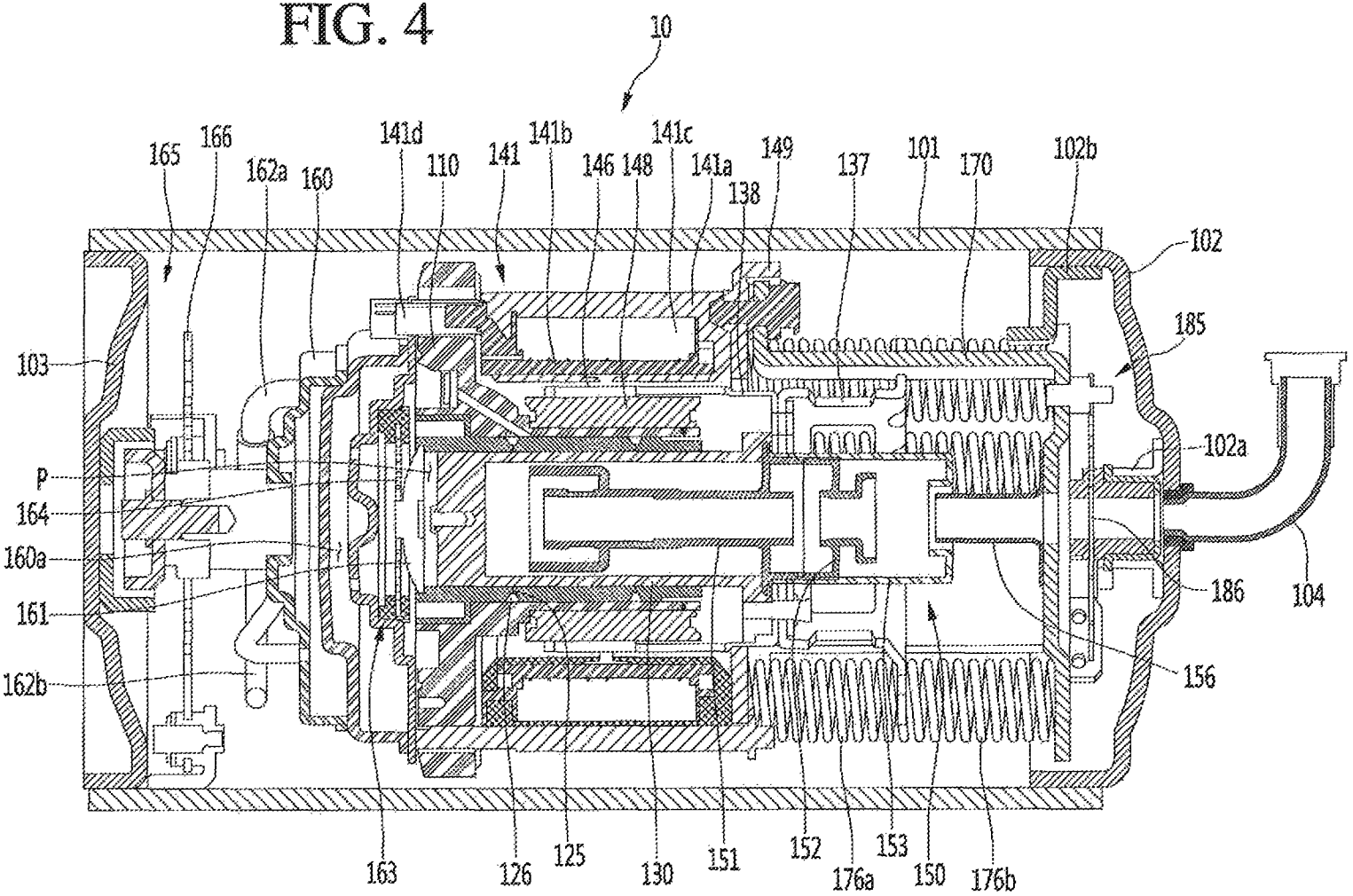
FIG. 4 is a cross-sectional view, taken along line I-I' of FIG. 1.

FIG. 3 is an exploded perspective view illustrating internal parts or components of the linear compressor according to an embodiment. FIG. 4 is a cross-sectional view illustrating internal parts or components of the linear compressor according to an embodiment.

Referring to FIGS. 3 and 4, the linear compressor 10 according to an embodiment may include a cylinder 120 provided in the shell 101, a piston 130 that linearly reciprocates within the cylinder 120, and a motor assembly 140 that functions as a linear motor for applying drive force to the piston 130. When the motor assembly 140 is driven, the piston 130 may linearly reciprocate in the axial direction.

The linear compressor 10 further includes the suction muffler 150 coupled to the piston 130 to reduce noise generated from the refrigerant suctioned through the suction pipe 104. The refrigerant suctioned through the suction pipe 104 may flow into the piston 130 via the suction muffler 150. For example, while the refrigerant passes through the suction muffler 150, a flow noise of the refrigerant may be reduced.

The suction muffler 150 may include a plurality of mufflers 151, 152, and 153. The plurality of mufflers 151, 152, and 153 include a first muffler 151, a second muffler 152, and a third muffler 153, which may be coupled to each other.

The first muffler 151 may be disposed or provided within the piston 130, and the second muffler 152 may be coupled to a rear portion of the first muffler 151. The third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 further includes a muffler filter 155. The muffler filter 155 may be disposed or provided on an interface on which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" may be understood as a direction in which the piston 130 reciprocates, that is, the horizontal direction in FIG. 4. Also, "in the axial direction", a direction from the suction pipe 104 toward a compression space P, that is, a direction in which the refrigerant flows may be defined as a "frontward direction", and a direction opposite to the frontward direction may be defined as a "rearward direction". When the piston 130 moves forward, the compression space P may be compressed. On the other hand, the "radial direction" may be understood as a direction which is perpendicular to the direction in which the piston 130 reciprocates, that is, the vertical direction in FIG. 4.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge cover 160 may define a discharge space 160*a* for the refrigerant discharged from the compression space P, and a discharge valve assembly 161 and 163 coupled to the discharge cover 160 to selectively discharge the refrigerant compressed in the compression space P may be provided at a front side of the compression space P. The discharge space 160*a* may include a plurality of space parts or spaces which may be partitioned by inner walls of the discharge cover 160.

The plurality of space parts may be disposed or provided in the frontward and rearward direction to communicate with each other.

The discharge valve assembly 161 and 163 may include a discharge valve 161 which may be opened when a pressure of the compression space P is above a discharge pressure to introduce the refrigerant into the discharge space 160*a* and a spring assembly 163 disposed or provided between the discharge valve 161 and the discharge cover 160 to provide an elastic force in the axial direction.

The spring assembly 163 may include a valve spring 163*a*, and a spring support part or support 163*b* that supports the valve spring 163*a* to the discharge cover 160. For example, the valve spring 163*a* may include a plate spring. Also, the spring support part 163*b* may be integrally injection-molded to the valve spring 163*a* through an injection-molding process, for example.

The discharge valve 161 may be coupled to the valve spring 163*a*, and a rear portion or rear surface of the discharge valve 161 may be disposed or provided to be supported on or at a front surface of the cylinder 120. When the discharge valve 161 is supported on or at the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

The compression space P may be understood as a space defined between the suction valve 135 and the discharge valve 161. The suction valve 135 may be disposed or provided on or at one side of the compression space P, and the discharge valve 161 may be disposed or provided on or at the other or a second side of the compression space P, that is, an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. The refrigerant may be discharged from the compression space P into the discharge space 160*a* of the discharge cover 160. When the discharge of the refrigerant is completed, the valve spring 163*a* may provide a restoring force to the discharge valve 161 to close the discharge valve 161.

The linear compressor 10 may further include a cover pipe 162*a* coupled to the discharge cover 160 to discharge the refrigerant flowing through the discharge space 160*a* of the discharge cover 160. For example, the cover pipe 162*a* may be made of a metal material.

The linear compressor 10 may further include a loop pipe 162*b* coupled to the cover pipe 162*a* to transfer the refrigerant flowing through the cover pipe 162*a* to the discharge pipe 105. The loop pipe 162*b* may have one or a first side coupled to the cover pipe 162*a* and the other or a second side coupled to the discharge pipe 105.

The loop pipe 162*b* may be made of a flexible material and have a relatively long length. Also, the loop pipe 162*b* may roundly extend from the cover pipe 162*a* along the inner circumferential surface of the shell 101 and be coupled to the discharge pipe 105. For example, the loop pipe 162*b* may have a wound shape.

The linear compressor 10 further includes a frame 110. The frame 110 may be understood as a component that fixes the cylinder 120. For example, the cylinder 120 may be press-fitted into the frame 110. Each of the cylinder 120 and the frame 110 may be made of aluminum or an aluminum alloy material, for example.

The frame 110 may be disposed or provided to surround the cylinder 120. That is, the cylinder 120 may be disposed or provided to be accommodated in the frame 110. The discharge cover 160 may be coupled to a front surface of the frame 110 using a coupling member.

The motor assembly 140 may include an outer stator 141 fixed to the frame 110 and disposed or provided to surround the cylinder 120, an inner stator 148 disposed or provided to be spaced inward from the outer stator 141, and a permanent magnet 146 disposed or provided in a space between the outer stator 141 and the inner stator 148. The permanent magnet 146 may linearly reciprocate by a mutual electromagnetic force between the outer stator 141 and the inner stator 148. Also, the permanent magnet 146 may be provided as a single magnet having one polarity or by coupling a plurality of magnets having three polarities to each other.

A magnet frame 138 may be installed or provided on the permanent magnet 146. The magnet frame 138 may have an approximately cylindrical shape and be disposed or provided to be inserted into the space between the outer stator 141 and the inner stator 148.

Referring to the cross-sectional view of FIG. 4, the magnet frame 138 may be coupled to the piston flange 132 to extend in an outer radial direction and then be bent forward. The permanent magnet 146 may be installed or provided on a front portion of the magnet frame 138. When the permanent magnet 146 reciprocates, the piston 130 may reciprocate together with the permanent magnet 146 in the axial direction.

The outer stator 141 may include coil winding bodies 141*b*, 141*c*, and 141*d* and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141. The terminal part 141*d* may be disposed or provided to be inserted into a terminal insertion part or portion (see reference numeral 119*c* of FIG. 6).

The stator core 141*a* may include a plurality of core blocks in which a plurality of laminations may be laminated in a circumferential direction. The plurality of core blocks may be disposed or provided to surround at least a portion of the coil winding bodies 141*b* and 141*c*.

A stator cover 149 may be disposed or provided on or at one or a first side of the outer stator 141. That is, the outer stator 141 may have one or a first side supported by the frame 110 and the other or a second side supported by the stator cover 149.

The linear compressor 10 may further include a cover coupling member 149*a* that couples the stator cover 149 to the frame 110. The cover coupling member 149*a* may pass through the stator cover 149 to extend forward to the frame 110 and then be coupled to a first coupling hole (see reference numeral 119*a* of FIG. 6) of the frame 110.

The inner stator 148 may be fixed to a circumference of the frame 110. Also, in the inner stator 148, the plurality of laminations may be laminated in the circumferential direction outside of the frame 110.

The linear compressor 10 may further include a support 137 that supports the piston 130. The support 137 may be coupled to a rear portion of the piston 130, and the muffler 150 may be disposed or provided to pass through the inside of the support 137. The piston flange 132, the magnet frame 138, and the support 137 may be coupled to each other using a coupling member.

A balance weight 179 may be coupled to the support 137. A weight of the balance weight 179 may be determined based on a drive frequency range of the compressor body.

The linear compressor 10 may further include a rear cover 170 coupled to the stator cover 149 to extend backward and supported by the second support device 185. The rear cover 170 may include three support legs, and the three support legs may be coupled to a rear surface of the stator cover 149. A spacer 181 may be disposed or provided between the three support legs and the rear surface of the stator cover 149. A distance from the stator cover 149 to a rear end of the rear cover 170 may be determined by adjusting a thickness of the spacer 181. Also, the rear cover 170 may be spring-supported by the support 137.

The linear compressor 10 may further include an inflow guide part or guide 156 coupled to the rear cover 170 to guide an inflow of the refrigerant into the muffler 150. At least a portion of the inflow guide part 156 may be inserted into the suction muffler 150.

The linear compressor 10 further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the rear cover 170. The drive part that reciprocates within the linear compressor 10 may be stably moved by the action of the plurality of resonant springs 176*a* and 176*b* to reduce vibration or noise due to movement of the drive part. The support 137 may include a first spring support part or support 137*a* coupled to the first resonant spring 176*a*.

The linear compressor 10 may include the frame 110 and a plurality of sealing members or seals 127, 128, 129*a*, and 129*b* that increase a coupling force between peripheral parts or components around the frame 110. The plurality of sealing members 127, 128, 129*a*, and 129*b* may include a first sealing member or seal 127 disposed or provided at a portion at which the frame 110 and the discharge cover 160 are coupled to each other. The first sealing member 127 may be disposed or provided on or in a second installation groove (see reference numeral 116*b* of FIG. 6) of the frame 110.

The plurality of sealing members 127, 128, 129*a*, and 129*b* may further include a second sealing member or seal 128 disposed or provided at a portion at which the frame 110 and the cylinder 120 are coupled to each other. The second sealing member 128 may be disposed or provided on or in a first installation groove (see reference numeral 116*a* of FIG. 6) of the frame 110.

The plurality of sealing members 127, 128, 129*a*, and 129*b* may further include a third sealing member or seal 129*a* disposed or provided between the cylinder 120 and the frame 110. The third sealing member 129*a* may be disposed or provided on or in a cylinder groove (see reference numeral 121*e* of FIG. 12) defined in the rear portion of the cylinder 120. The third sealing member 129*a* may prevent external leakage of a refrigerant of a gas pocket (see reference numeral 110*b* of FIG. 12) and function to increase a coupling force between the frame 110 and the cylinder 120.

The plurality of sealing members 127, 128, 129*a*, and 129*b* may further include a fourth sealing member or seal 129*b* disposed or provided at a portion at which the frame 110 and the inner stator 148 are coupled to each other. The fourth sealing member 129*b* may be disposed or provided on or in a third installation groove (see reference numeral 111*a* of FIG. 10) of the frame 110. Each of the first to fourth sealing members 127, 128, 129*a*, and 129*b* may have a ring shape.

The linear compressor 10 further may include a first support device or support 165 coupled to the discharge cover 160 to support one or a first side of the main body of the linear compressor 10. The first support device 165 may be disposed or provided adjacent to the second shell cover 103 to elastically support the main body of the linear compressor 10. The first support device 165 may include a first support spring 166. The first support spring 166 may be coupled to the spring coupling part 101*a*.

The linear compressor 10 may further include a second support device or support 185 coupled to the rear cover 170 to support the other or a second side of the main body of the linear compressor 10. The second support device 185 may be coupled to the first shell cover 102 to elastically support the main body of the linear compressor 10. The second support device 185 may include a second support spring 186. The second support spring 186 may be coupled to the cover support part 102*a*.

Figure 5:
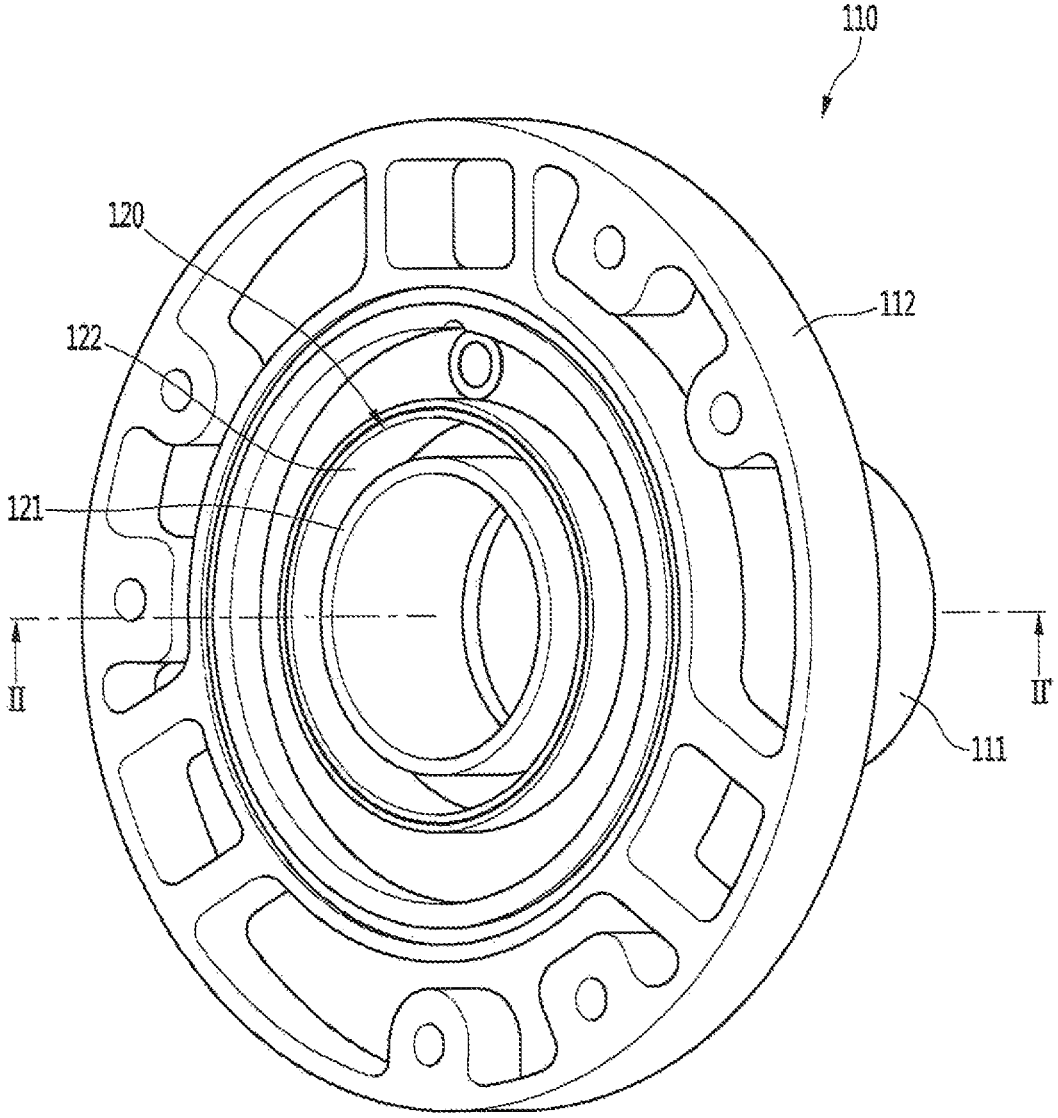
FIG. 5 is a perspective view illustrating a state in which a frame and a cylinder are coupled to each other according to an embodiment.
Figure 6:
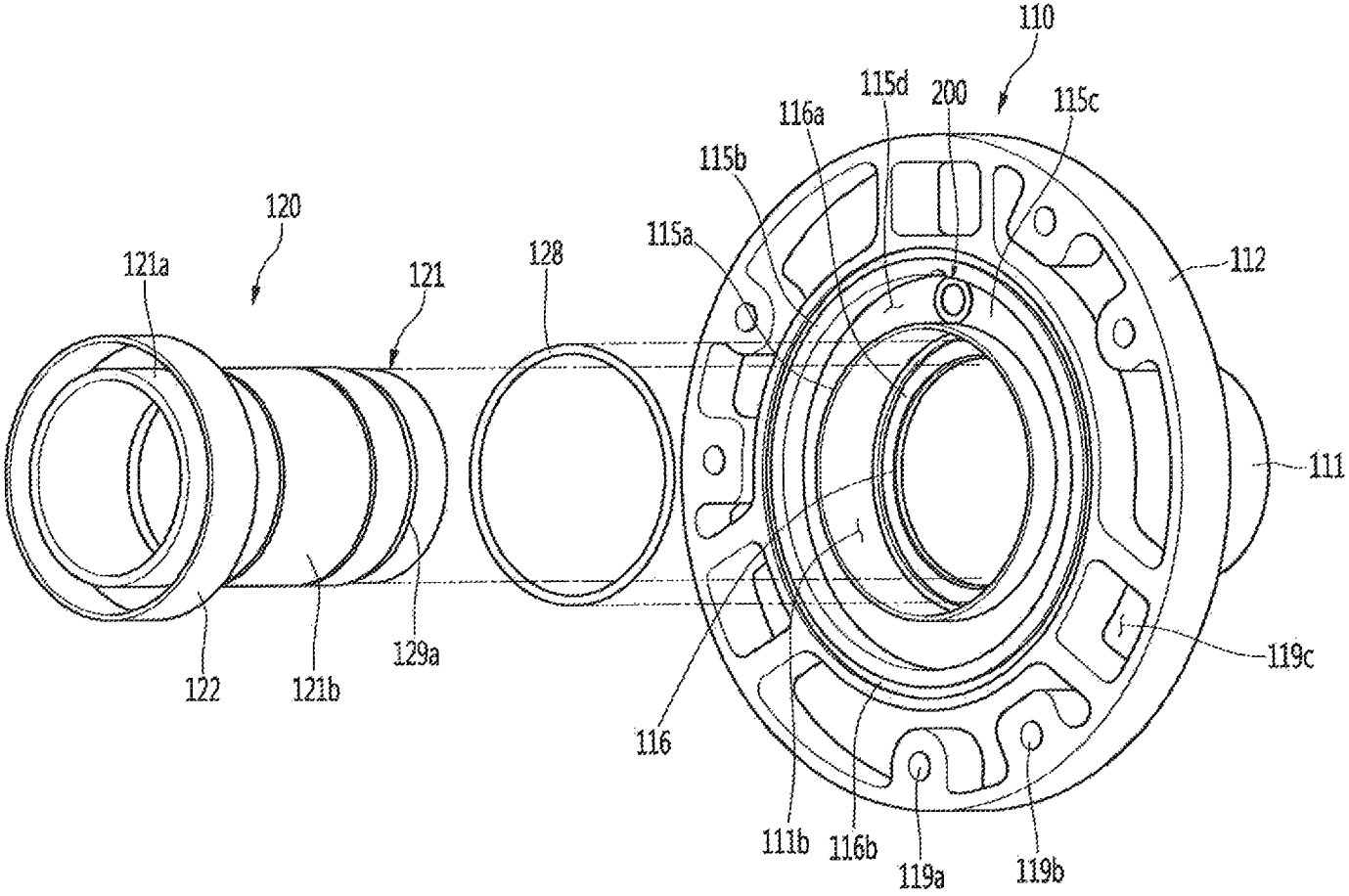
FIG. 6 is an exploded perspective view illustrating the frame and the cylinder according to an embodiment.
Figure 7:
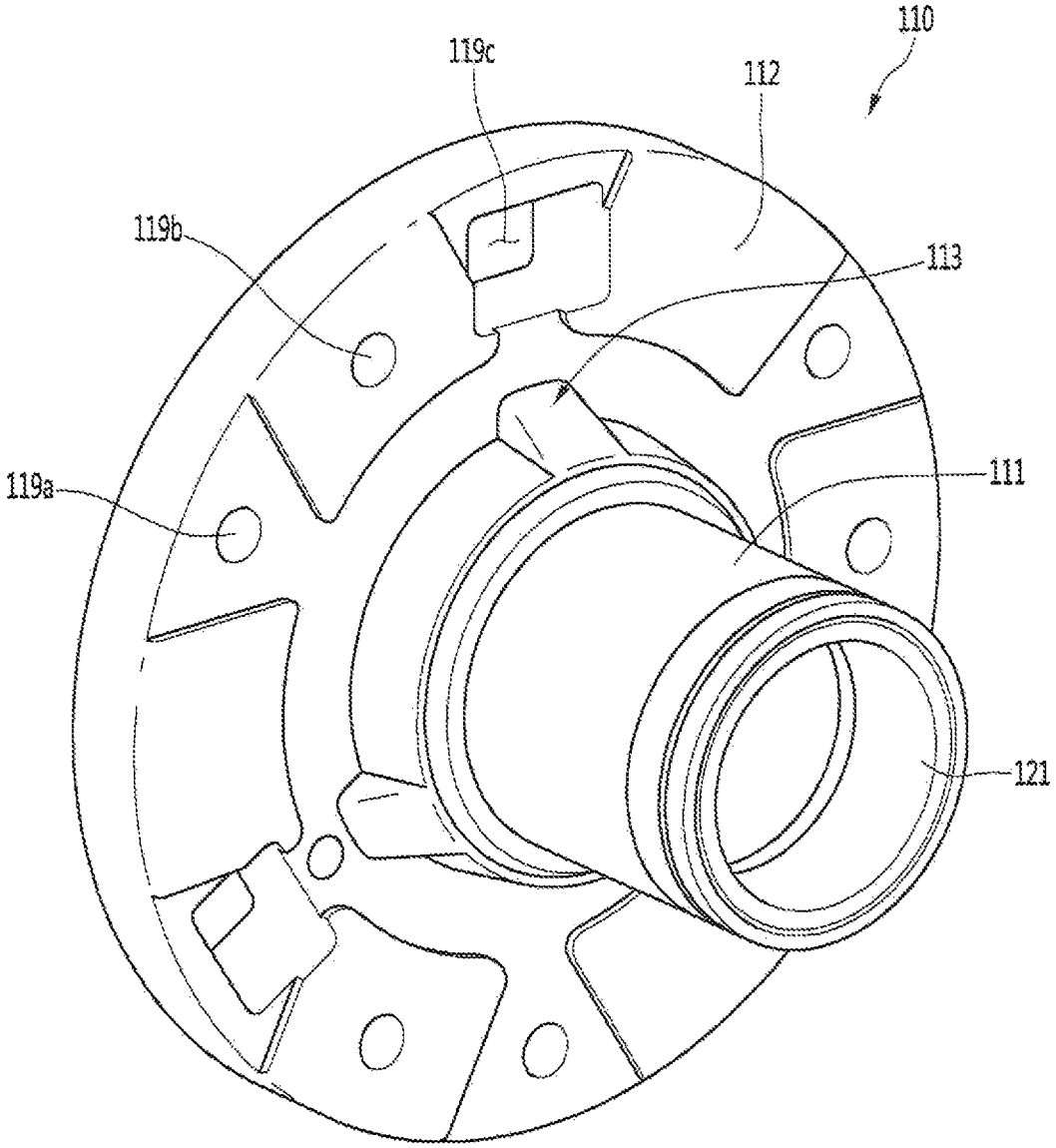
FIG. 7 is a perspective view illustrating a state in which the frame and the cylinder are coupled to each other according to an embodiment.
Figure 8:
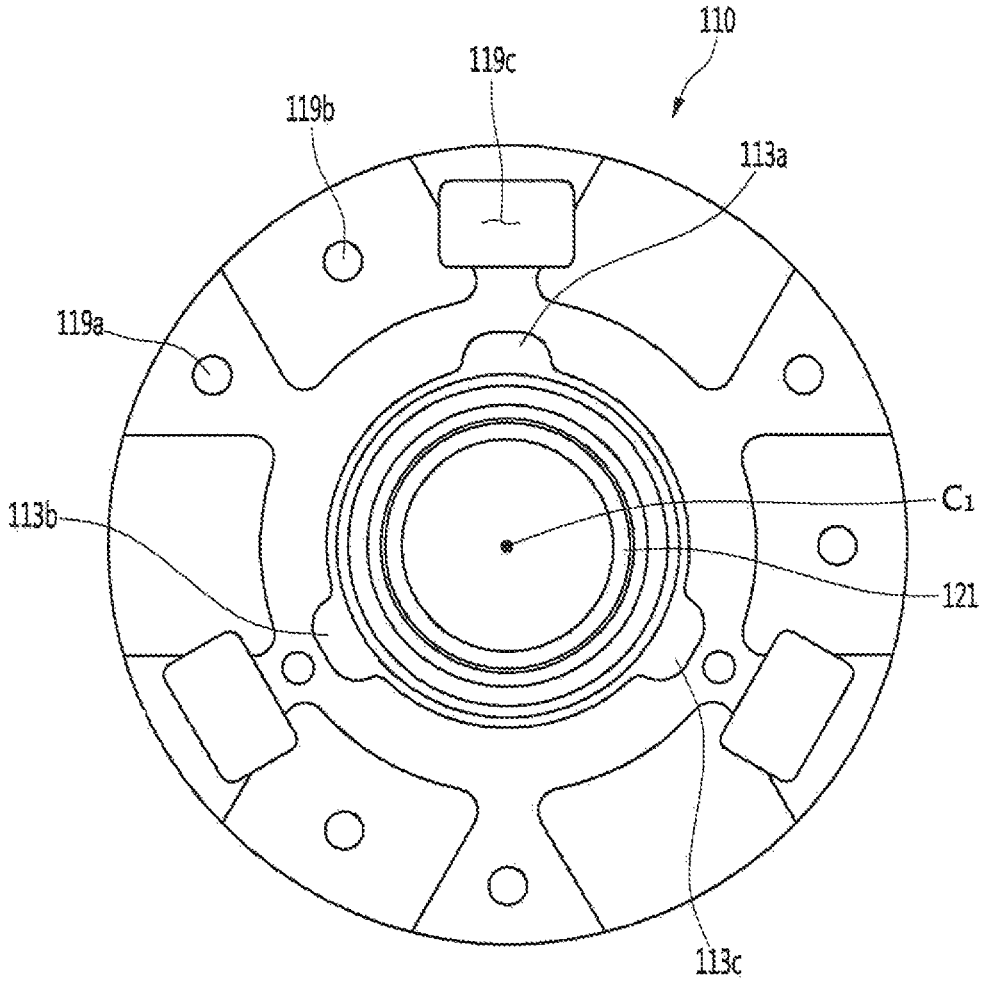
FIG. 8 is a right or first side view illustrating a state in which the frame and the cylinder are coupled to each other according to an embodiment.
Figure 9:
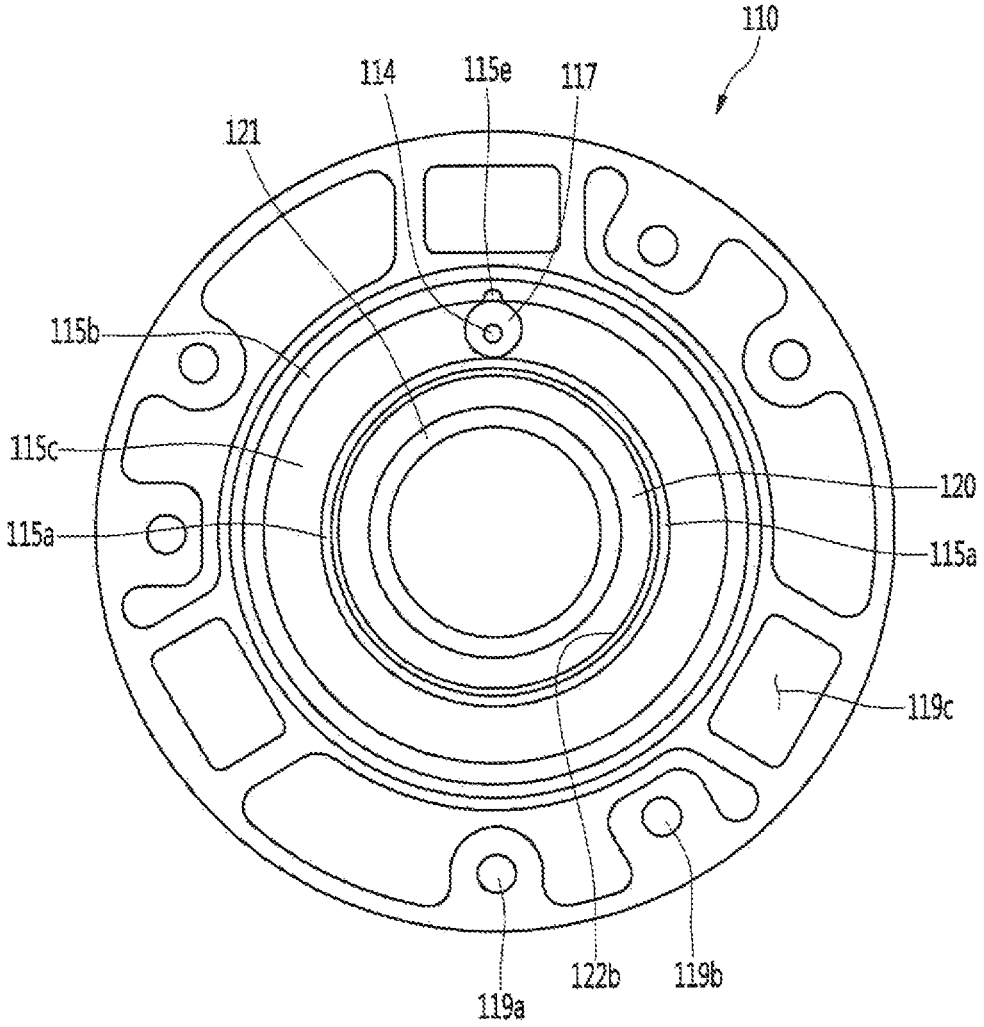
FIG. 9 is a left or second side view illustrating a state in which the frame and the cylinder are coupled to each other according to an embodiment.
Figure 10:
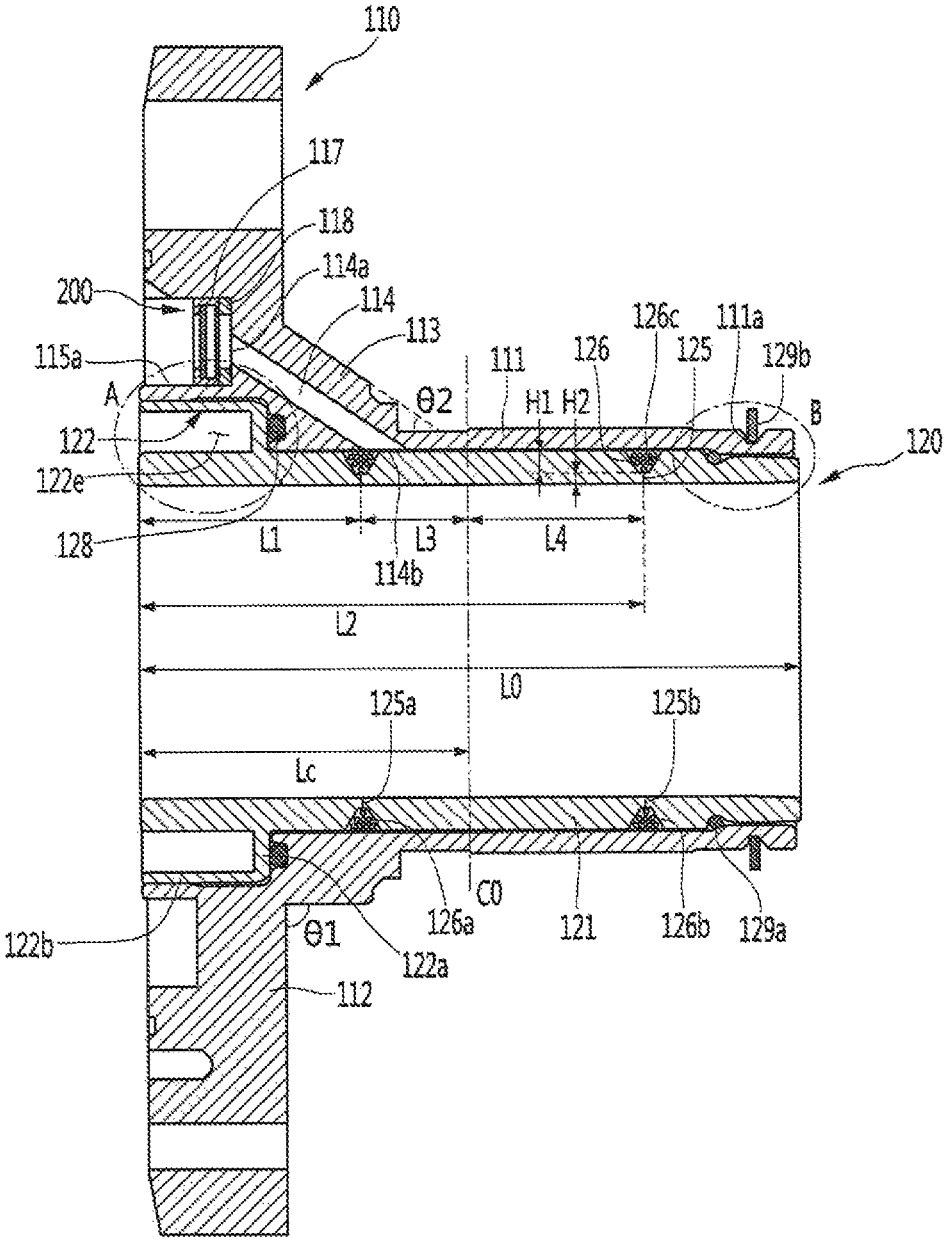
FIG. 10 is a cross-sectional view, taken along line II-II' in FIG. 5.

FIG. 5 is a perspective view illustrating a state in which a frame and a cylinder are coupled to each other according to an embodiment. FIG. 6 is an exploded perspective view illustrating the frame and the cylinder according to an embodiment. FIG. 7 is a perspective view illustrating a state in which the frame and the cylinder are coupled to each other according to an embodiment. FIG. 8 is a right or a first side view illustrating a state in which the frame and the cylinder are coupled to each other according to an embodiment. FIG. 9 is a left or a second side view illustrating a state in which the frame and the cylinder are coupled to each other according to an embodiment. FIG. 10 is a cross-sectional view, taken along line II-II' of FIG. 5.

Referring to FIGS. 5 to 10, the cylinder 120 according to an embodiment may be coupled to the frame 110. For example, the cylinder 120 may be inserted into the frame 110.

The frame 110 includes a frame body 111 that extends in the axial direction and a frame flange 112 that extends outward from the frame body 111 in the radial direction. That is, the frame flange 112 may extend from an outer circumferential surface of the frame body 111 at a first preset or predetermined angle θ1. For example, the first preset angle θ1 may be about 90°.

The frame body 111 may have a cylindrical shape with a central axis or central longitudinal axis in the axial direction and have a body accommodation part or portion that accommodates the cylinder body 121. A third installation groove 111*a*, in which a fourth sealing member or seal 129*b* may be disposed or provided between the frame body 111 and the inner stator 148, may be defined in a rear portion of the frame body 111.

The frame flange 112 may include a first wall 115*a* having a ring shape and coupled to the cylinder flange 122, a second wall 115*b* having a ring shape and disposed or provided to surround the first wall 115*a*, and a third wall 115*c* that connects a rear end of the first wall 115*a* to a rear end of the second wall 115*b*. Each of the first wall 115*a* and the second wall 115*b* may extend in the axial direction, and the third wall 115*c* may extend in the radial direction.

A frame space part or space 115*d* may be defined by the first to third walls 115*a*, 115*b*, and 115*c*. The frame space part 115*d* may be recessed backward from a front end of the frame flange 112 to form a portion of the discharge passage through which the refrigerant discharged through the discharge valve 161 may flow.

A second installation groove 116*b* which may be defined in a front end of the second wall 115*b* and in which the first sealing member 127 may be installed or provided is defined in the frame flange 112.

A cylinder accommodation part or portion 111*b*, into which at least a portion of the cylinder 120, for example, the cylinder flange 122 may be inserted, may be defined in an inner space of the first wall 115*a*. For example, an inner diameter of the cylinder accommodation part 111*b* may be equal to or slightly less than an outer diameter of the cylinder flange 122.

When the cylinder 120 is press-fitted into the frame 110, the cylinder flange 122 may interfere with the first wall 115*a*. In this process, the cylinder flange 122 may be deformed.

The frame flange 112 may further include a sealing member seating part or seat 116 that extends inward from a rear end of the first wall 115*a* in the radial direction. A first installation groove 116*a*, into which the second sealing member 128 may be inserted, may be defined in the sealing member seating part 116. The first installation groove 116*a* may be recessed rearward from the sealing member seating part 116.

The frame flange 112 may further include coupling holes 119*a* and 119*b* to which a predetermined coupling member that couples the frame 110 to peripheral parts or components may be coupled. A plurality of the coupling holes 119*a* and 119*b* may be provided along an outer circumference of the second wall 115*b*.

The coupling holes 119*a* and 119*b* may include a first coupling hole 119*a* to which the cover coupling member 149*a* may be coupled. A plurality of the first coupling hole 119*a* may be provided, and the plurality of first coupling holes 119*a* may be disposed or provided to be spaced apart from each other. For example, three first coupling holes 119*a* may be provided.

The coupling holes 119*a* and 119*b* may further include a second coupling hole 119*b* to which a predetermined coupling member that couples the discharge cover 160 to the frame 110 may be coupled. A plurality of the second coupling hole 119*b* may be provided, and the plurality of second coupling holes 119*b* may be disposed or provided to be spaced apart from each other. For example, three second coupling holes 119*b* may be provided.

As the three first coupling holes 119*a* and the three second coupling holes 119*b* may be defined along the outer circumference of the frame flange 112, that is, uniformly defined in a circumferential direction with respect to a central portion C1 of the frame 110, the frame 110 may be supported at three points of the peripheral parts, that is, the stator cover 149 and the discharge cover 160, and thus, stably coupled.

The frame flange 112 may include a terminal insertion part or portion 119*c* that provides a withdrawing path of a terminal part or portion 141*d* of the motor assembly 140. The terminal insertion part 119*c* may be formed such that the frame flange 112 is cut out in the frontward and rearward direction. The terminal part 141*d* may extend forward from the coil 141*c* and be inserted into the terminal insertion part 119*c*. Thus, the terminal part 141*d* may be exposed to the outside from the motor assembly 140 and the frame 110 and connected to a cable which is directed to the terminal 108.

A plurality of the terminal insertion part 119*c* may be provided. The plurality of terminal insertion parts 119*c* may be disposed or provided along the outer circumference of the second wall 115*b*. Only one terminal insertion part 119*c*, into which the terminal part 141*d* may be inserted, of the plurality of terminal insertion parts 119*c* may be provided. The remaining terminal insertion parts 119*c* may be understood as components that prevent the frame 110 from being deformed.

For example, three terminal insertion parts 119*c* may be provided in the frame flange 112. In the three terminal insertion parts 119*c*, the terminal part 141*d* may be inserted into one terminal insertion part 119*c*, and the terminal part 141*d* may not be inserted into the remaining two terminal insertion parts 119*c*.

When the frame 110 is coupled to the stator cover 149 or the discharge cover 160 or when the cylinder 120 is press-fitted into the frame 110, a large stress may be applied to the frame 110. If only one terminal insertion part 119*c* is provided in the frame flange 112, the stress may be concentrated on or at a specific point, causing deformation of the frame flange 112. Thus, in this embodiment, the three terminal insertion parts 119*c* may be provided in the frame flange 112, that is, uniformly disposed in the circumferential direction with respect to the central portion C1 of the frame 110 to prevent the stress from being concentrated.

The frame 110 may further include a frame connection part or portion 113 that extends at an incline from the frame flange 112 to the frame body 111. An outer surface of the frame connection part 113 may extend at a second preset or predetermined angle θ2 with respect to the outer circumferential surface of the frame body 111, that is, in the axial direction. For example, the second preset angle θ2 may be greater than about 0° and less than about 90°.

A gas hole 114 that guides the refrigerant discharged from the discharge valve 161 to a gas inflow part or inflow 126 of the cylinder 120 may be defined in the frame connection part 113. The gas hole 114 may pass through an inside of the frame connection part 113.

The gas hole 114 may extend from the frame flange 112 up to the frame body 111 via the frame connection part 113. As the gas hole 114 may be defined by passing through a portion of the frame having a relatively thick thickness up to the frame flange 112, the frame connection part 113, and the frame body 111, the frame 110 may be prevented from being reduced in strength due to the formation of the gas hole 114. An extension direction of the gas hole 114 may correspond to an extension direction of the frame connection part 113 to form the second preset angle θ2 with respect to the inner circumferential surface of the frame body 111, that is, in the axial direction.

A discharge filter 200 that filters foreign substances from the refrigerant introduced into the gas hole 114 may be disposed or provided on or at an inlet part or inlet of the gas hole 114. The discharge filter 200 may be installed or provided on the third wall 115*c*.

The discharge filter 200 may be installed or provided on or in a filter groove 117 defined in the frame flange 112. The filter groove 117 may be recessed backward from the third wall 115*c* and have a shape corresponding to a shape of the discharge filter 200.

That is, the inlet part 114*a* of the gas hole 114 may be connected to the filter groove 117, and the gas hole 114 may pass through the frame flange 112 and the frame connection part 113 from the filter groove 117 to extend to the inner circumferential surface of the frame body 111. Thus, an outlet part or outlet of the gas hole 114 may communicate with the inner circumferential surface of the frame body 111.

The linear compressor 10 may further include a filter sealing member or seal 118 installed or provided at a rear side, that is, an outlet side of the discharge filter 200. The filter sealing member 118 may have an approximately ring shape. The filter sealing member 118 may be placed on or in the filter groove 117. When the discharge filter 200 presses the filter groove 117, the filter sealing member 118 may be press-fitted into the filter groove 117.

A plurality of the frame connection part 113 may be provided along a circumference of the frame body 111. Only one frame connection part 113, in which the gas hole 114 may be defined, of the plurality of frame connection parts 113 may be provided. The remaining frame connection parts 113 may be understood as components that prevent the frame 110 from being deformed.

For example, the frame 110 may include a first frame connection part or portion 113*a*, a second frame connection part or portion 113*b*, and a third frame connection frame 113*c*. Among them, the gas hole 114 may be provided in the first frame connection part 113*a*, and the gas hole 114 may not be provided in the second and third frame connection parts 113*b* and 113*c*.

When the frame 110 is coupled to the stator cover 149 or the discharge cover 160 or when the cylinder 120 is press-fitted into the frame 110, a large stress may be applied to the frame 110. If only one frame connection part 113 is provided in the frame flange 112, the stress may be concentrated on or at a specific point, causing deformation of the frame 110. Thus, in this embodiment, the three frame connection parts 113 may be provided in the frame body 111, that is, uniformly disposed or provided in the circumferential direction with respect to the central portion C1 of the frame 110 to prevent the stress from being concentrated.

The cylinder 120 may be coupled to an inside of the frame 110. For example, the cylinder 120 may be coupled to the frame 110 through a press-fitting process.

The cylinder 120 may include a cylinder body 121 that extends in the axial direction, and a cylinder flange 122 disposed or provided outside of a front portion of the cylinder body 121. The cylinder body 121 may have a cylindrical shape with a central axis or central longitudinal axis in the axial direction and may be inserted into the frame body 111. Thus, an outer circumferential surface of the cylinder body 121 may be disposed or provided to face an inner circumferential surface of the frame body 111. The gas inflow part 126 into which the gas refrigerant flowing through the gas hole 114 may be introduced may be provided in the cylinder body 121.

The linear compressor 10 may further include a gas pocket (see reference numeral 110*b* of FIG. 12) disposed or provided between the inner circumferential surface of the frame 110 and the outer circumferential surface of the cylinder 120 through which gas used for the gas bearing may flow. A cooling gas passage from the outlet part 114*b* of the gas hole 114 to the gas inflow part 126 may define at least a portion of the gas pocket 110*b*. Also, the gas inflow part 126 may be disposed or provided at an inlet side of a cylinder nozzle 125, which will be described hereinafter.

The gas inflow part 126 may be recessed inward from the outer circumferential surface of the cylinder body 121 in the radial direction. The gas inflow part 126 may have a circular shape along the outer circumferential surface of the cylinder body 121 with respect to the central axis in the axial direction.

A plurality of the gas inflow part 126 may be provided. For example, two gas inflow parts 126 may be provided. A first gas inflow part or inflow 126*a* of the two gas inflow parts 126 may be disposed or provided on or at a front portion of the cylinder body 121, that is, at a position which is close to the discharge valve 161, and a second gas inflow part or inflow 126*b* is disposed or provided on or at a rear portion of the cylinder body 121, that is, at a position which is close to a compressor suction side of the refrigerant. That is, the first gas inflow part 126*a* may be disposed or provided at a front side with respect to a central portion Co in the frontward and rearward direction of the cylinder body 121, and the second gas inflow part 126*b* may be disposed or provided at a rear side. Also, a first nozzle part or nozzle 125*a* connected to the first gas inflow part 126*a* may be disposed or provided at the front side with respect to the central portion Co, and a second nozzle part or nozzle 125*b* connected to the second gas inflow part 126*b* may be disposed or provided at the rear side with respect to the central portion Co.

The first gas inflow part 126*a* or the first nozzle part 125*a* may be disposed or provided at a position which is spaced a first distance L1 from the front end of the cylinder body 121. Each of the second gas inflow part 126*b* or the second nozzle part 125*b* may be disposed or provided at a position which is spaced a second distance L2 from the front end of the cylinder body 121. The second distance L2 may be greater than the first distance L1. A third distance Lc from the front end of the cylinder body 121 to the central portion Co may be greater than the first distance L1 and less than the second distance L2.

A fourth distance L3 from the central portion Co to the first gas inflow part 126*a* or the first nozzle part 125*a* may be determined as a value which is less than a fifth distance L4 from the central portion Co to the second gas inflow part 126*b* or the second nozzle part 125*b*.

When a length of the cylinder 120 in the frontward and rearward direction is Lo, a distance from the front end of the cylinder 120 to the first gas inflow part 126*a* may be L1, and a distance from the front end of the cylinder 120 to the second gas inflow part 126*b* may be L2. Positions of the first and second gas inflow parts 126*a* and 126*b* may be determined within the following range. For example, L1/Lo may be determined within a range of about 0.33 to about 0.43, and L2/Lo may be determined within a range of about 0.68 to about 0.86.

In the range of L1 and L2, a range of a flow rate of the refrigerant used as the gas bearing may satisfy a range of about 250 ml/min to about 350 ml/min. A flow rate condition may be a predetermined condition that improves an effect of the gas bearing.

If a flow rate condition which is less than the range of the flow rate of the refrigerant is formed, it is difficult to provide a sufficient lifting force for lifting the piston 130 within the cylinder 120. On the other hand, if a flow rate condition which is greater than the range of the flow rate of the refrigerant is formed, an amount of refrigerant used as the gas bearing may be too much, deteriorating compression efficiency. Thus, in this embodiment, the positions of the first and second gas inflow parts 126*a* and 126 are set as described above to solve the above-described limitation.

On the other hand, the first gas inflow part 126*a* may be disposed or provided at a position which is adjacent to the outlet part 114*b* of the gas hole 114. That is, a distance from the outlet part 114*b* of the gas hole 114 to the first gas inflow part 126*a* may be less than a distance from the outlet part 114*b* to the second gas inflow part 126*b*.

An internal pressure of the cylinder 120 may be relatively high at a position which is close to the discharge side of the refrigerant, that is, an inside of the first gas inflow part 126*a*. Thus, the outlet part 114*b* of the gas hole 114 may be disposed or provided adjacent to the first gas inflow part 126*a*, so that a relatively large amount of refrigerant may be introduced toward an inner central portion of the cylinder 120 through the first gas inflow part 126*a*. As a result, the function of the gas bearing may be enhanced. Also, while the piston 130 reciprocates, abrasion between the cylinder 120 and the piston 130 may be prevented.

A cylinder filter member or filter 126*c* may be installed or provided on or in the gas inflow part 126. The cylinder filter member 126*c* may prevent a foreign substance having a predetermined size or more from being introduced into the cylinder 120 and perform a function for adsorbing oil contained in the refrigerant. The predetermined size may be about 1 μm.

The cylinder filter member 126*c* may include a thread which is wound around the gas inflow part 126. The thread may be made of a polyethylene terephthalate (PET) material and have a predetermined thickness or diameter.

The thickness or diameter of the thread may be determined to have adequate dimensions in consideration of a strength of the thread. If the thickness or diameter of the thread is too small, the thread may be easily broken due to a very weak strength thereof. On the other hand, if the thickness or diameter of the thread is too large, a filtering effect with respect to the foreign substances may be deteriorated due to a very large pore in the gas inflow part 126 when the thread is wound.

The cylinder body 121 may further include a cylinder nozzle 125 that extends inward from the gas inflow part 126 in the radial direction. The cylinder nozzle 125 may extend up to the inner circumferential surface of the cylinder body 121.

A length H2 in the radial direction of the cylinder nozzle 125 may be less than a length H1, that is, a recessed depth of the gas inflow part 126 in the radial direction. An inner space of the cylinder nozzle 125 may have a volume less than a volume of the gas inflow part 126. A recessed depth and width of the gas inflow part 126 and a length of the cylinder nozzle 125 may be determined to have adequate dimensions in consideration of a rigidity of the cylinder 120, an amount of cylinder filter member 126*c*, or an intensity in pressure drop of the refrigerant passing through the cylinder nozzle 125.

For example, if the recessed depth and width of the gas inflow part 126 are very large, or the length of the cylinder nozzle 125 is very short, the rigidity of the cylinder 120 may be weak. On the other hand, if the recessed depth and width of each of the gas inflow part 126 are very small, an amount of cylinder filter member 126*c* installed or provided on or in the gas inflow part 126 may be very small. Also, if the length H2 of the cylinder nozzle 125 is too long, the pressure drop of the refrigerant passing through the nozzle part 123 may be too large, and it may be difficult to perform the sufficient function as the gas bearing.

In this embodiment, a ratio of the length H2 of the cylinder nozzle 125 to the length H1 of the gas inflow part 126 may be within a range of about 0.65 to about 0.75. The effect of the gas bearing may be improved within the above-described ratio range, and the rigidity of the cylinder 120 may be maintained to a desired level.

An inlet part or inlet of the cylinder nozzle 125 may have a diameter greater than a diameter of an outlet part or outlet thereof. In a flow direction of the refrigerant, a flow sectional area of the cylinder nozzle 125 may gradually decrease from the inlet part 123*a* to the outlet part 123*b*. The inlet part may be understood as a portion connected to the gas inflow part 126 to introduce the refrigerant into the cylinder nozzle 125, and the outlet part may be understood as a portion connected to the inner circumferential surface of the cylinder 120 to supply the refrigerant to the outer circumferential surface of the piston 130.

If the diameter of the cylinder nozzle 125 is too small, an amount of refrigerant, which is introduced from the cylinder nozzle 125, of the high-pressure gas refrigerant discharged through the discharge valve 161 may be too large, increasing a flow loss in the compressor. On the other hand, if the diameter of the cylinder nozzle 125 is too small, the pressure drop in the cylinder nozzle 125 may increase, reducing the performance as the gas bearing.

Thus, in this embodiment, the inlet part 123*a* of the cylinder nozzle 125 may have a relatively large diameter to reduce the pressure drop of the refrigerant introduced into the cylinder nozzle 125. In addition, the outlet part 123*b* may have a relatively small diameter to control an inflow amount of gas bearing through the cylinder nozzle 125 to a predetermined value or less.

For example, in this embodiment, a ratio of the diameter of the inlet part to the diameter of the outlet part of the cylinder nozzle 125 may be determined as a value of about 4 to about 5. The effect of the gas bearing may be expected within the above-described range.

The cylinder nozzle 125 may include first nozzle part 125*a* that extends from the first gas inflow part 126*a* to the inner circumferential surface of the cylinder body 121, and second nozzle part 125*b* that extends from the second gas inflow part 126*b* to the inner circumferential surface of the cylinder body 121. The refrigerant which is filtered by the cylinder filter member 126*c* while passing through the first gas inflow part 126*a* may be introduced into a space between the inner circumferential surface of the first cylinder body 121 and the outer circumferential surface of the piston body 131 through the first nozzle part 125*a*. Also, the refrigerant which is filtered by the cylinder filter member 126*c* while passing through the second gas inflow part 126*b* may be introduced into a space between the inner circumferential surface of the first cylinder body 121 and the outer circumferential surface of the piston body 131 through the second nozzle part 125*b*. The gas refrigerant flowing to the outer circumferential surface of the piston body 131 through the first and second nozzle parts 125*a* and 125*b* may provide the lifting force to the piston 130 to perform a function as the gas bearing with respect to the piston 130.

The cylinder flange 122 may include a first flange first press that extends outward from the flange coupling part or portion (see reference numeral 121*c* of FIG. 11) of the cylinder body 121 in the radial direction, and a second flange 122*b* that extends forward from the first flange 122*a*. A cylinder front part or portion 121*a* of the cylinder body 121 and the first and second flanges 122*a* and 122*b* may define a deformable space part or space 122*e* which is deformable when the cylinder 120 is press-fitted into the frame 110.

The second flange 122*b* may be press-fitted into an inner surface of the first wall 115*a* of the frame 110. That is, press-fitting parts or portions 115*h* and 122*c* may be formed on the inner surface of the first wall 115*a* and the outer surface of the second flange 122*b*. During the press-fitting process, the second flange 122*b* may be deformable toward the deformable space part 122*e*. As the second flange 122*b* may be spaced apart from the outside of the cylinder body 121, the cylinder body 121 may not be affected even when the second flange 122*b* is deformed. Thus, the cylinder body 121 mutually operating with the piston 130 may not be deformed by the gas bearing. The cylinder body 121 may define a cylinder front part or portion 121*a* on or at a front side and a cylinder rear part or portion 121*b* on or at a rear side with respect to the flange coupling part 121*c*.

A guide groove 115*e* for easily processing the gas hole 114 may be defined in the frame flange 112. The guide groove 115*e* may be formed by recessing at least a portion of the second wall 115*b* and defined in an edge of the filter groove 117.

While the gas hole 114 is processed, a processing mechanism may be drilled from the filter groove 117 to the frame connection part 113. The processing mechanism may interfere with the second wall 115*b*, causing a limitation in that the drilling is not easy. Thus, in this embodiment, the guide groove 115*e* may be defined in the second wall 115*b*, and the processing mechanism may be disposed or provided in the guide groove 115*e* so that the gas hole 114 may be easily processed.

Figure 11:
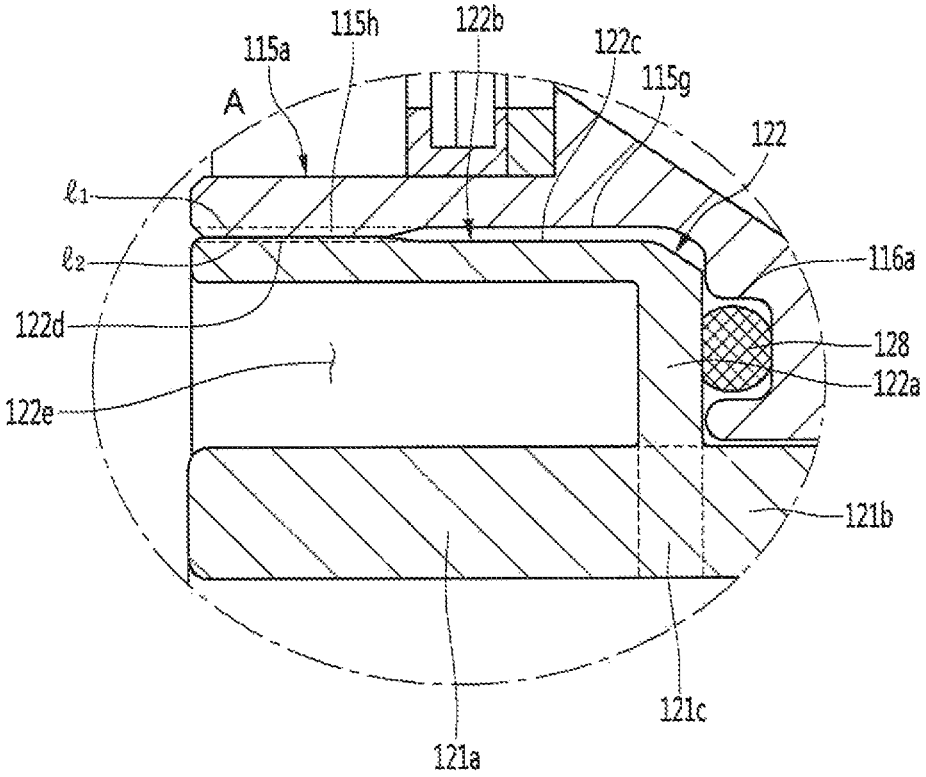
FIG. 11 is an enlarged view illustrating a portion A of FIG. 10.
Figure 12:
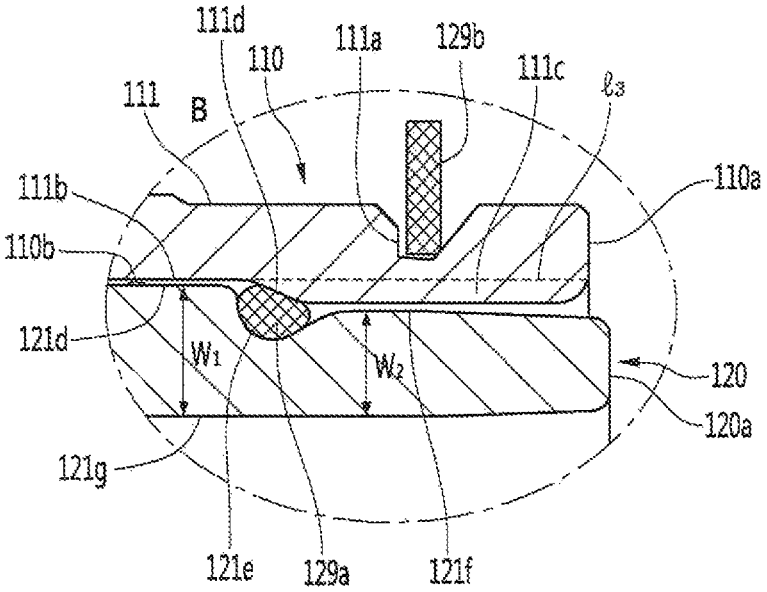
FIG. 12 is an enlarged view illustrating a portion B of FIG. 10.
Figure 13:
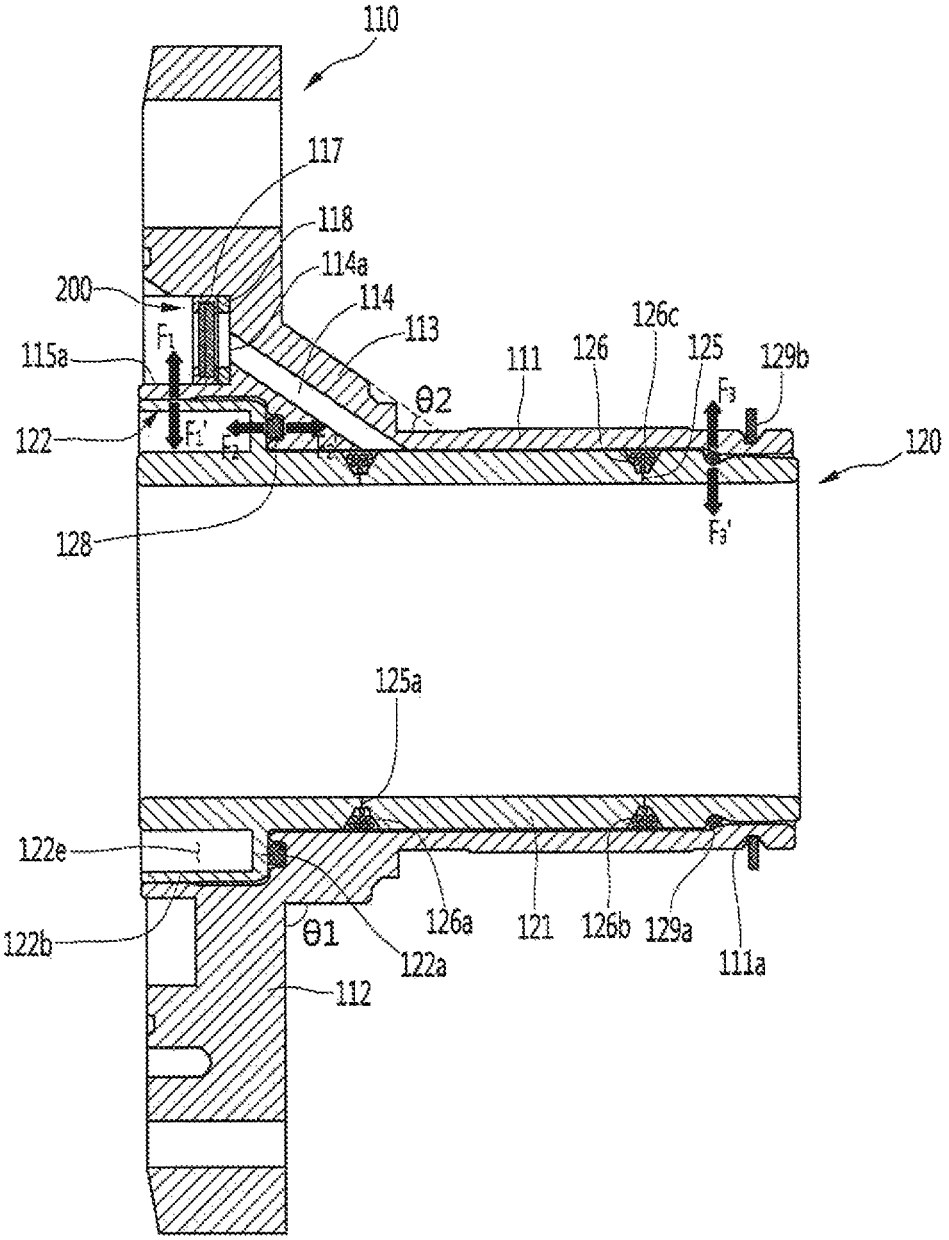
FIG. 13 is a cross-sectional view illustrating an action of a force between the frame and the cylinder in a state in which the frame and the cylinder are coupled to each other according to an embodiment.

FIG. 11 is an enlarged view illustrating a portion A of FIG. 10. FIG. 12 is an enlarged view illustrating a portion B of FIG. 10. FIG. 13 is a cross-sectional view illustrating an action of a force between the frame and the cylinder in a state in which the frame and the cylinder are coupled to each other according to an embodiment.

Referring to FIG. 11, the cylinder body 121 according to an embodiment may include a flange coupling part or portion 121*c* to which the cylinder flange 122 may be coupled, a cylinder front part or portion 121*a* that defines a front portion of the flange coupling part 121*c*, and a cylinder rear part or portion 121*b* that defines a rear portion of the flange coupling part 121*c*. The frame 110 and the cylinder 120 may be coupled to each other by press-fit. For example, the first wall 115*a* of the frame 110 and the cylinder flange 122 of the cylinder 120 are press-fitted.

The first wall 115*a* of the frame 110 may include a wall body 115*g* that surrounds the second flange 122*b*, and a first press-fitting part or portion 115*h* that protrudes from an inner circumferential surface of the wall body 115*g*. The first press-fitting part 115*h* may protrude inward from the inner circumferential surface of the wall body 115*g* in the radial direction with respect to a first virtual line l1 extending forward from the inner circumferential surface of the wall body 115*g*. In other words, the first press-fitting part 115*h* may protrude from the inner circumferential surface of the wall body 115*g* in a direction approaching the second press-fitting part 122*d* of the second flange 122*b*. Also, the first press-fitting part 115*h* that extend from one point of the wall body 115*g* to a front end of the first wall 115*a*.

The second flange 122*b* of the cylinder 120 may include a flange body 122*c* surrounded by the first wall 115*a*, and a second press-fitting part or portion 122*d* that protrudes from an outer circumferential surface of the flange body 122*c*.

The second press-fitting part 122*d* may protrude outward from the outer circumferential surface of the flange body 122*c* in the radial direction with respect to a second virtual line l2 extending forward from the outer circumferential surface of the flange body 122*c*. In other words, the second press-fitting part 122*d* may protrude from the outer circumferential surface of the flange body 122*c* in a direction approaching the first press-fitting part 115*h*. Also, the first press-fitting part 122*d* may extend from one point of the flange body 122*c* to a front end of the second flange 122*b*.

When the cylinder 120 is inserted into the frame 110, the first press-fitting part 115*h* and the second press-fitting part 122*d* may interfere with each other. In this case, a direction in which the cylinder 120 is inserted may be a direction in which the cylinder body 121 is inserted into the frame body 111 via the cylinder accommodation part 111*b*, that is, a rightward direction on FIG. 6.

The outer diameter of the frame body 111 may be slightly greater than the inner diameter of the cylinder body 121. A size of a space corresponding to a distance obtained by subtracting the inner diameter of the cylinder body 121 from the outer diameter of the frame body 111 may form a volume of the gas pocket 110*b*.

The inner diameter of the wall body 115*g* may be slightly greater than the outer diameter of the flange body 122*c*. On the other hand, the inner diameter of the first press-fitting part 115*h* may be equal to or greater than the outer diameter of the second press-fitting part 122*d*.

Thus, the cylinder 120 may be relatively easily inserted until before the first press-fitting part 115*h* and the second press-fitting part 122*d* interfere with each other. However, if the first press-fitting part 115*h* and the second press-fitting part 122*d* begin to interfere with each other, the cylinder 120 is inserted when a force having a preset or predetermined magnitude or more is applied. The force having the preset magnitude may be determined based on the protruding lengths of the first and second press-fitting parts 115*h* and 122*d*.

In the process of being press-fitted with the first and second press-fitting parts 115*h* and 122*d*, the cylinder flange 122 or the first wall 115*a* may be deformed by reaction forces F1 and F1' acting on each other. Even when the first wall 115*a* is deformed, an amount of deformation may be damped by the deformable space part 122*e*. Thus, the cylinder body 121 may not be deformed. Therefore, there is an advantage that does not affect the performance of the gas bearing.

When the cylinder 120 is inserted up to a position where the press-fitting between the first and second press-fitting parts 115*h* and 122*d* is completed, the rear end of the first flange 122*a* may come into close contact with the second sealing member 128. The second sealing member 128 may prevent the cylinder 120 or the frame 110 from being deformed or damaged when the cylinder 120 and the frame 110 are coupled to each other. The reaction forces F2 and F2' through the second sealing member 128 may increase a coupling force between the cylinder 120 and the frame 110.

Referring to FIG. 12, the frame 110 according to an embodiment may include a frame body 111 that surrounds the cylinder body 121. The frame body 111 may include a frame inner circumferential surface 111*b* facing a first outer circumferential surface 121*d* of the cylinder rear part 121*b*.

A space part or space between the first outer circumferential surface 121*d* and the frame inner circumferential surface 111*b* may define at least a portion of the gas pocket 110*b*. The frame 110 may further include the sealing member pressing part 111*c* that protrudes from the frame inner circumferential surface 111*b* of the frame body 111 and presses the third sealing member 129*a*.

The sealing member pressing part 11*c* may protrude inward from the frame inner circumferential surface 111*b* in the radial direction with respect to a third virtual line l3 extending rearward from the frame inner circumferential surface 111*b*. In other words, the sealing member pressing part 111*c* may protrude from the frame inner circumferential surface 111*b* in a direction approaching the third sealing member 129*a* or the second outer circumferential surface 121*f* of the cylinder rear part 121*b*.

The sealing member pressing part 111*c* may extend from one point of the frame body 111 to the rear end 110*a* of the frame 110. The front portion of the sealing member pressing part 111*c* may include the press inclination part 111*d* that extends at an incline inward in the radial direction.

That is, due to the press inclination part 111*d*, the sealing member pressing part 111*c* may gradually protrude toward the rear side. According to such a structure, as the insertion of the cylinder 120 progresses, a pressing force transferred from the sealing member pressing part 111*c* to the third sealing member 129*a* may gradually increase.

The outer circumferential surface of the cylinder rear part 121*b* may include first and second outer circumferential surfaces 121*d* and 121*f* and a cylinder groove 121*e* between the first and second outer circumferential surfaces 121*d* and 121*f*. The cylinder groove 121*e* may have a shape recessed from the first and second outer circumferential surfaces 121*d* and 121*f*.

The first outer circumferential surface 121*d* may be understood as an outer circumferential surface extending rearward from the flange coupling part 121*c* toward the cylinder groove 121*e*. The second outer circumferential surface 121*f* may be understood as an outer circumferential surface extending from the cylinder groove 121*e* toward a rear end 120*a* of the cylinder 120.

A thickness w1 of the cylinder rear part 121*b* where the first outer circumferential surface 121*d* is positioned may be greater than a thickness w2 of the cylinder rear part 121*b* where the second outer circumferential surface 121*f* is positioned. That is, a shortest distance between the first outer circumferential surface 121*d* and the inner circumferential surface 121*g* of the cylinder 120 may be longer than a shortest distance between the second outer circumferential surface 121*d* and the inner circumferential surface 121*g*. According to such a structure, the cylinder 120 may be easily inserted into the frame 110, and the third sealing member 129*a* may be easily pressed by the sealing member pressing part 111*c*.

Pressing-fitting between the third sealing member 129*a* and the sealing member pressing part 111*c* may be easily achieved. When the third sealing member 129*a* is installed on the cylinder groove 121*e*, the third sealing member 129*a* may further protrude outward than the outer circumferential surface of the cylinder body 121, that is, the second outer circumferential surface 121*f*.

In this state, the cylinder 120 may be inserted into the frame 110. When the third sealing member 129*a* reaches the sealing member pressing part 111*c* of the frame 110, the sealing member pressing part 11*c* may press the third sealing member 129*a*, thereby resulting in deformation of the third sealing member 129*a*. As a result, the third sealing member 129*a* may fill the space of the cylinder groove 121*e*.

On the other hand, a time point when the third sealing member 129*a* and the sealing member pressing part 111*c* are press-fitted may correspond to a time point when the first and second press-fitting parts 115*h* and 122*d* interfere with each other. That is, when the first and second press-fitting parts 115*h* and 122*d* interfere with each other, the third sealing member 129*a* may be pressed by the sealing member pressing part 111*c* of the frame 110. When the press-fitting of the cylinder 120 is completed, the third sealing member 129*a* may come into close contact with the frame 110 and the cylinder 120 by a restoration force (reaction forces F3 and F3').

According to the above-described structure and the press-fitting process, as the rear portion and the rear portion of the cylinder 120 may strongly contact the frame 110, the coupling force between the cylinder 120 and the frame 110 may increase and it is possible to prevent the cylinder 120 from being separated from the frame 110. As the third sealing member 129*a* seals a rear space of the gas pocket 110*b*, the refrigerant flowing through the gas pocket 110*b* may be prevented from leaking to the rear side of the cylinder 120 and the frame 110. Therefore, the performance of the gas bearing may be improved.

Figure 14:
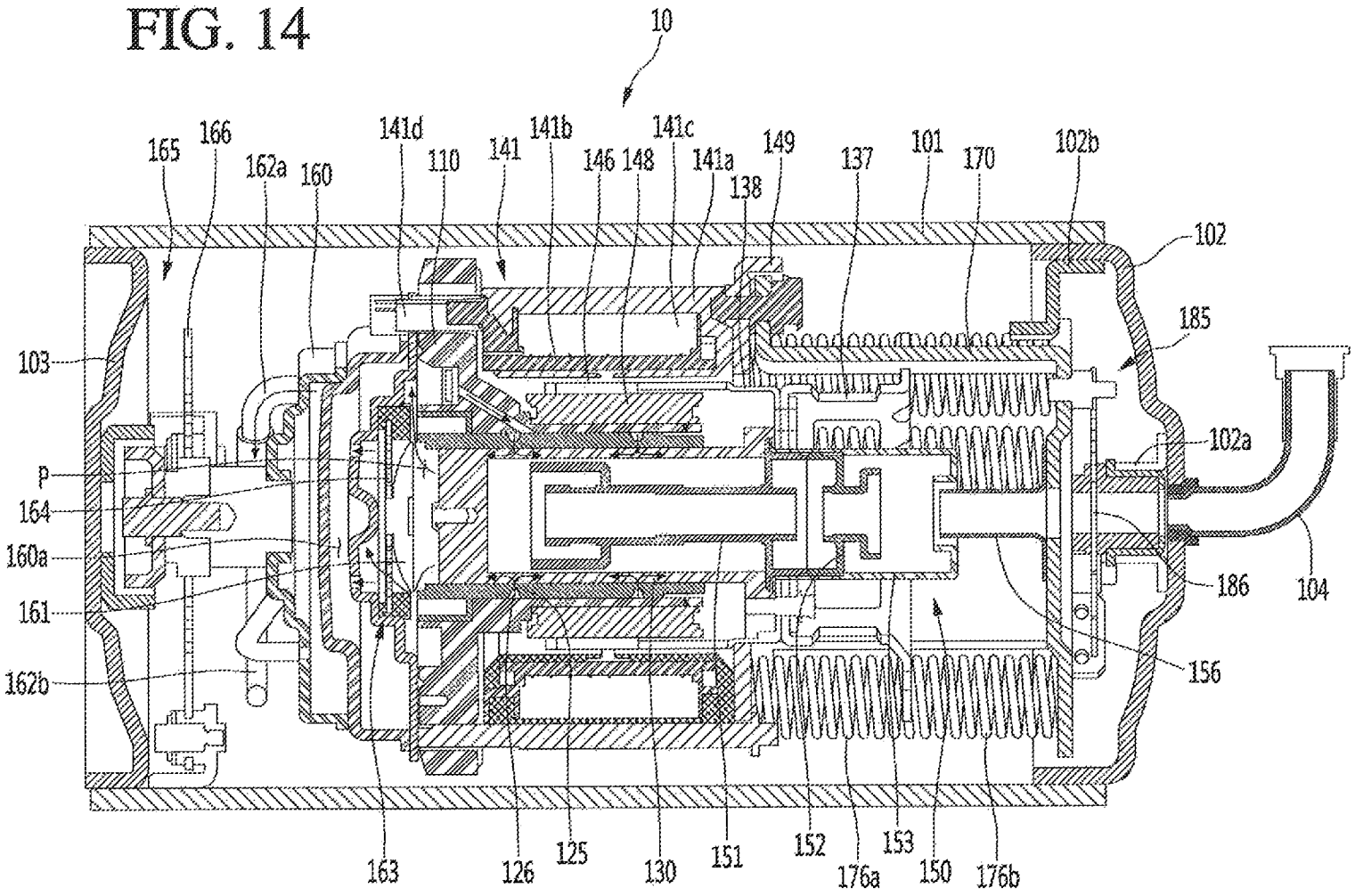
FIG. 14 is a cross-sectional view illustrating a state in which a refrigerant flows in the linear compressor according to an embodiment.

FIG. 14 is a cross-sectional view illustrating a state in which a refrigerant flows in the linear compressor according to an embodiment. A flow of the refrigerant in the linear compressor 10 according to an embodiment will be described with reference to FIG. 14. The refrigerant suctioned into the shell 101 through the suction pipe 104 may flow into the piston 130 via the suction muffler 150. At this time, when the motor assembly 140 is driven, the piston 130 may reciprocate in the axial direction.

When the suction valve 135 coupled to the front side of the piston 130 is opened, the refrigerant may be introduced and compressed in the compression space P. When the discharge valve 161 is opened, the compressed refrigerant may be discharged from the compression space P, and a portion of the discharged refrigerant may flow toward the frame space part 115*d* of the frame 110. Most of the remaining refrigerant may pass through the discharge space 160*a* of the discharge cover 160 and be discharged through the discharge pipe 105 via the cover pipe 162*a* and the loop pipe 162*b*.

On the other hand, the refrigerant of the frame space part 115*d* may flow rearward and pass through the discharge filter 200. In this process, foreign substances or oil contained in the refrigerant may be filtered.

The refrigerant passing through the discharge filter 200 may flow into the gas hole 114, be supplied between the inner circumferential surface of the cylinder 120 and the outer circumferential surface of the piston 130, and perform a gas bearing. According to such an operation, the bearing function may be performed using at least a portion of the discharged refrigerant, without using oil, thereby preventing abrasion of the piston or the cylinder.

According to the embodiments disclosed herein, the compressor including internal parts or components may decrease in size to reduce a volume of a machine room of a refrigerator, and thus, an inner storage space of the refrigerator may increase. Also, a drive frequency of the compressor may be increased to prevent the internal parts or components from being deteriorated in performance due to the decreased size thereof. In addition, the gas bearing may be applied between the cylinder and the piston to reduce a friction force generated by the oil.

Further, as the cylinder and the frame is assembled by the press-fitting process, it is possible to achieve a stable coupling between the cylinder and the frame and prevent leakage of the refrigerant through the coupling portion between the cylinder and the frame. Furthermore, as the cylinder flange extends outward from the cylinder body to secure the deformable space part or space between the cylinder body and the cylinder flange, the cylinder body mutually operating with the piston may not be deformed even though the cylinder flange is deformed during the press-fitting process.

As the sealing members or seals may be provided in the front portion and the rear portion of the cylinder, the refrigerant flowing to the gas pocket between the cylinder and the frame may not leak out through the front portion and the rear portion of the cylinder. Also, a coupling force between the cylinder and the frame may be increased by the force applied from the sealing member to the cylinder and the frame.

The second sealing member may be stably seated on the frame flange, and an impulse occurring between the cylinder flange and the frame flange during the press-fitting of the cylinder and the frame may be absorbed by the second sealing member, thereby reducing damage or deformation in the cylinder or the frame. As the cylinder groove may be defined in the rear portion of the cylinder and the third sealing member inserted into the cylinder groove and pressed by the sealing member pressing part of the frame, a contact force between the cylinder and the frame may be improved through the third sealing member. Also, the third sealing member may be provided on the rear side of the cylinder nozzle, that is, on the rear side of the gas pocket, thereby preventing the refrigerant flowing through the gas pocket from leaking toward the rear side of the cylinder.

Additionally, as the plurality of frame connection parts may be uniformly disposed or provided in the frame along the outer circumferential surface of the frame body, it is possible to prevent a stress concentration on or at a specific position during the press-fitting process of the cylinder and the frame, thereby preventing the deformation of the frame.

As the plurality of terminal insertion parts may be uniformly disposed or provided in the frame flange along the circumferential surface of the frame flange, it is possible to prevent a stress concentration on or at a specific position during the press-fitting process of the cylinder and the frame, thereby preventing deformation of the frame. Also, due to the press-fitting process of the cylinder and the frame, the assembling process may be simplified and the assembling cost may be reduced.

Embodiments disclosed herein provide a linear compressor in which a frame and a cylinder may be stably coupled to each other. Embodiments disclosed herein also provide a linear compressor capable of preventing deformation of a cylinder body in a press-fitting process of a frame and a cylinder.

Embodiments further provide a linear compressor capable of preventing external leakage of a refrigerant gas discharged through a discharge valve and reducing pressure loss in a process of supplying a refrigerant gas to a nozzle of a cylinder. Embodiments provide a linear compressor in which a work process of a cylinder and a frame may be simple and a low work expense involved.

Embodiments disclosed herein provide a linear compressor that may include a cylinder that defines a compression space compressed by a piston, and a frame coupled to an outer side of the cylinder and press-fitted into the cylinder. The cylinder may include a cylinder flange that extends from an outer circumferential surface of a cylinder body, and the frame may include a frame flange press-fitted with the cylinder flange.

The frame flange may include a first wall having a first press-fitting part or portion, and the cylinder flange may include a second press-fitting part or portion to which the first press-fitting part may be coupled. The cylinder flange may include a first flange that extends from the cylinder body in a radial direction, and a second flange in which the second press-fitting part may be formed.

The cylinder body may include a flange coupling part or portion to which the cylinder flange may be coupled; a cylinder front part or portion that extends from the flange coupling part toward a front end of the cylinder body; and a cylinder rear part or portion that extends from the flange coupling part toward a rear end of the cylinder body. The cylinder front part, the first flange, and the second flange may define a deformable space part or space allowing deformation of the cylinder flange.

The frame flange may include a sealing member seating part or seat that extends from the first wall in the radial direction and having an installation groove and a sealing member or seal provided on or at the installation groove. The linear compressor may further include a sealing member or seal installed or provided between the frame and the cylinder and contacting the second flange.

A plurality of the frame connection part may be provided, and one of the plurality of frame connection parts may defines a gas hole through which a refrigerant flows.

The linear compressor may further include a motor assembly that provides a drive force to the piston and including a coil and a terminal part or portion. One of the plurality of terminal insertion parts may be disposed or provided such that the terminal part may be inserted thereinto.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a cylinder including a cylinder body defining a compression space for a refrigerant and a cylinder flange that extends from the cylinder body in a radial direction;

a piston that reciprocates within the cylinder body in an axial direction; and a frame coupled to the cylinder, wherein the frame includes:

a frame body into which the cylinder body is inserted;

a frame flange that extends outward from the frame body, the frame flange including a first wall that surrounds an outer circumferential surface of the cylinder flange and in which a first press-fitting portion is formed; and a sealing member seat that extends inward from the first wall in the radial direction and in which a groove is formed, wherein the cylinder flange includes:

a first flange that extends from an outer circumferential surface of the cylinder body in the radial direction; and a second flange that extends from the first flange in the axial direction, the second flange having a second press-fitting portion coupled to the first press-fitting portion, wherein a space is defined by the first flange, the second flange, and the cylinder body, to allow deformation of the cylinder flange, and wherein a first sealing member is provided in the groove such that the first flange contacts the first sealing member.

2. The linear compressor according to claim 1, wherein the first wall of the frame flange is coupled to the outer circumferential surface of the cylinder flange, and wherein the frame flange further includes a second wall that surrounds the first wall.

3. The linear compressor according to claim 2, wherein the first press-fitting portion is provided on an inner circumferential surface of the first wall, and wherein the second press-fitting portion is provided on an outer circumferential surface of the second flange.

4. The linear compressor according to claim 1, wherein the cylinder body includes:

a flange coupling portion coupled to the cylinder flange;

a cylinder front portion that extends from the flange coupling portion toward a front end of the cylinder body; and a cylinder rear portion that extends from the flange coupling portion toward a rear end of the cylinder body.

5. The linear compressor according to claim 4, wherein the cylinder front portion, the first flange, and the second flange define the space allowing deformation of the cylinder flange.

6. The linear compressor according to claim 1, further including a second sealing member which is provided in a gas pocket between the frame and the cylinder and contacts the second flange.

7. The linear compressor according to claim 2, wherein the frame flange further includes a third wall that connects the first wall to the second wall and extends in the radial direction.

8. The linear compressor according to claim 7, further including:

a discharge valve provided at a front side of the compression space of the cylinder and operated to be opened or closed; and a frame space defined by the first wall, the second wall, and the third wall and forming a discharge passage through which the refrigerant discharged through the discharge valve flows.

9. The linear compressor according to claim 1, wherein the frame further includes at least one frame connection portion that extends from the frame flange to the frame body and is inclined at a predetermined angle with respect to an outer circumferential surface of the frame body.

10. The linear compressor according to claim 9, wherein the at least one frame connection portion includes a plurality of frame connection portions, and one of the plurality of frame connection portions defines a gas hole through which the refrigerant flows.

11. The linear compressor according to claim 1, further including:

a plurality of terminal insertion portions defined in the frame flange and having a cut-out shape in the axial direction; and a motor assembly that provides a drive force to the piston and includes a coil and a terminal portion, wherein that the terminal portion is inserted into one of the plurality of terminal insertion portions.

12. The linear compressor according to claim 1, further including:

a gas inflow provided on the outer circumferential surface of the cylinder body and in which a cylinder filter member is provided; and a cylinder nozzle that extends inward from the gas inflow in the radial direction and supplies the refrigerant toward an inner circumferential surface of the cylinder body, wherein a ratio of a length of the cylinder nozzle in the radial direction to a length of the gas inflow in the radial direction is in a range of about 0.65 to about 0.75.

13. The linear compressor according to claim 6, wherein the cylinder body of the cylinder includes a cylinder groove, and wherein a third sealing member is provided in the cylinder groove.

14. The linear compressor according to claim 13, wherein the frame includes an installation groove, and wherein a fourth sealing member is provided in the installation groove.

15. The linear compressor according to claim 14, wherein each of the first sealing member, the second sealing member, the third sealing member, and the fourth sealing member have a ring shape.

* * * * *